US008967158B2

(12) United States Patent
Sanbonmatsu

(10) Patent No.: US 8,967,158 B2
(45) Date of Patent: Mar. 3, 2015

(54) ARTIFICIAL EYELASH AND METHOD FOR ATTACHING THE SAME

(75) Inventor: Masahiko Sanbonmatsu, Osaka (JP)

(73) Assignee: Matsukaze Co., Ltd., Osaka (JP)

( * ) Notice: Subject to any disclaimer, the term of this patent is extended or adjusted under 35 U.S.C. 154(b) by 251 days.

(21) Appl. No.: 13/137,684

(22) Filed: Sep. 2, 2011

(65) Prior Publication Data

US 2012/0055499 A1 Mar. 8, 2012

(30) Foreign Application Priority Data

| | | |
|---|---|---|
| Sep. 3, 2010 | (JP) | 2010-197572 |
| Apr. 11, 2011 | (JP) | 2011-001984 |
| Apr. 11, 2011 | (JP) | 2011-001985 |
| Jun. 30, 2011 | (JP) | 2011-003725 |

(51) Int. Cl.
*A41G 5/02* (2006.01)

(52) U.S. Cl.
CPC ..... *A41G 5/02* (2013.01)
USPC ..... 132/201; 132/216

(58) Field of Classification Search
CPC ..... A41G 5/02
USPC ..... 132/53–56, 201, 216; 424/78.31, 499, 424/501
See application file for complete search history.

(56) References Cited

U.S. PATENT DOCUMENTS

| | | | | |
|---|---|---|---|---|
| 3,790,434 | A * | 2/1974 | Sone et al. | 428/400 |
| 4,767,827 | A | 8/1988 | Iwatsuki et al. | |
| 2001/0011544 | A1* | 8/2001 | Yamada | 132/201 |
| 2005/0061341 | A1 | 3/2005 | Choe | |
| 2006/0275603 | A1 | 12/2006 | Sato | |
| 2008/0023019 | A1* | 1/2008 | Kurahashi et al. | 132/216 |
| 2009/0178689 | A1* | 7/2009 | Navarro et al. | 132/201 |
| 2010/0275939 | A1* | 11/2010 | Shinbayashi | 132/53 |

FOREIGN PATENT DOCUMENTS

| | | | |
|---|---|---|---|
| JP | 62-206007 | A | 9/1987 |
| JP | 02045051 | A * | 2/1990 |
| JP | 05-321009 | A | 12/1993 |
| JP | 10-183415 | A | 7/1998 |
| JP | 2004-232147 | A | 8/2004 |
| JP | 2005146500 | A | 6/2005 |
| JP | 2008231632 | A | 10/2008 |
| JP | 2010024579 | A | 2/2010 |
| WO | WO 2004/106600 | A1 | 12/2004 |

OTHER PUBLICATIONS

Abstract translation of JP02045051A Jamada, Shiro Feb. 1990.*

* cited by examiner

*Primary Examiner* — Robyn Doan
(74) *Attorney, Agent, or Firm* — Harness, Dickey & Pierce, P.L.C.

(57) ABSTRACT

An artificial eyelash 100 for increasing a length of an eyelash 50 is disclosed. The artificial eyelash 100 disclosed herein includes an artificial eyelash main body 10 and an annular member 20 for coupling the artificial eyelash main body 10 and the eyelash 50. The annular member 20 is formed of a shrinkable material.

12 Claims, 20 Drawing Sheets

ARTIFICIAL EYELASH AND METHOD FOR ATTACHING THE SAME

BACKGROUND OF THE INVENTION

1. Field of the Invention

The present invention relates to an artificial eyelash, and specifically to an eyelash extension.

The present application claims the benefit of priority based upon Japanese Patent Application No. 2010-197572 filed on Sep. 3, 2010, Japanese Utility Model Application No. 2011-1984 filed on Apr. 11, 2011, Japanese Utility Model Application No. 2011-1985 filed on Apr. 11, 2011, and Japanese Utility Model Application No. 2011-3725 filed on Jun. 30, 2011, the entirety of which are incorporated herein by reference.

2. Description of the Related Art

A set of false eyelashes is provided for adding length and volume to natural eyelashes and thus making eyes appear larger, more beautiful and more attractive. A false eyelash set is produced by tying a plurality of artificial eyelashes and providing a glue portion at an end thereof. The glue portion is attached to an eyelid of a user, and thus the false eyelash set can add length and volume to the natural eyelashes of the user (e.g., Japanese Laid-Open Patent Publications Nos. 2008-231632 and 2005-146500). Such a false eyelash set is bonded to the skin of the user, and so makes the user feel uncomfortable and occasionally gives a rash to the skin of the user.

In the meantime, an artificial eyelash having substantially the same shape as that of a natural eyelash and adding length and volume thereto, namely, a so-called "extension" has been recently proposed (e.g., Japanese Laid-Open Patent Publication No. 2010-24579). The extension (artificial eyelash) is not bonded to the eyelid but is directly bonded to an eyelash with glue. Therefore, the extension makes the user feel comfortable and has a lower risk of giving a rash to the skin of the user. Since one extension is bonded to one eyelash, such extensions can add length and volume to the eyelashes more naturally than the false eyelashes.

As described above, the extension is bonded to the eyelash with glue, and so can lower the risk of giving a rash to the skin as compared with a false eyelash, the glue component of which is in contact with the skin (eyelid). However, even though the glue is bonded to the eyelash instead of the skin (eyelid), when a user whose skin easily gets a rash due to an allergic reaction to the glue uses the extension, a volatile substance of the glue or the solidified glue may possibly cause a rash to the skin of the user. There is medical glue which does not easily cause a rash to the skin. However, it is merely that such glue does not easily cause a rash and it is not that such glue never causes a rash. Such glue is not commonly used in the industry of eyelash extensions and false eyelashes. In addition, such medical glue may cause problems in terms of costs because the materials thereof cost about 100 times higher than the glue typically used in the industry of eyelash extensions and false eyelashes.

Moreover, even if the glue does not cause a rash to the skin of the user, the smell of the glue may give a discomfort or cause sneezing or a runny nose to the user. These problems may be caused to both of the users and engineers who attach the extensions. However, the extensions cannot be attached to the eyelashes without glue, and such discomfort cannot be avoided. There is another problem that when the bonding surfaces have oil components or stains, the extensions are easily detached.

The extension disclosed in Japanese Laid-Open Patent Publication No. 2010-24579 has a recessed portion which covers at least ¼ of the eyelash of the user. A glue is applied to the extension having such a recessed portion, and the eyelash of the user is put into close contact with the recessed portion of the extension. Thus, the extension can be bonded to the eyelash. Owing to the close contact of the eyelash with the recessed portion, the bonding area size of the extension and the eyelash can be increased, which easily prevents the extension from being detached or slipped.

However, it takes a lot of time and labor to accurately fit the recessed portion to each of the eyelashes from below. An extension with no recessed portion (usual extension) can be bonded to the eyelash with glue; whereas in the case of the extension disclosed in Japanese Laid-Open Patent Publication No. 2010-24579, each eyelash needs to be fit to an inner face of the recessed portion of the extension. The extension with such a recessed portion is held by tweezers for operation, and so it needs time and labor to direct the inner face of the recessed portion upward each time.

The extension is not directly attached to the eyelid and so has a lower risk of causing a rash to the skin. For this reason, it has not been conceived to make the extension antibacterial in the industry of extensions. However, the extension is kept attached to the eyelid and so it is not preferable that bacteria are propagated in the extension.

The present inventor noted such problems of extensions, and conducted active studies in an attempt to solve the problems from a viewpoint different from the conventional viewpoint. The present invention, made in light of such a situation, has a main object of providing a novel artificial eyelash. Specifically, an object of the present invention is to provide an artificial eyelash attachable with no use of glue. Another object of the present invention is to provide an artificial eyelash extension on which glue stays well. Still another object of the present invention is to provide an eyelash extension on which glue stays well and which is lightweight. Still another object of the present invention is to provide an eyelash extension which is antibacterial.

SUMMARY OF THE INVENTION

An artificial eyelash in an embodiment according to the present invention is an artificial eyelash for increasing a length of an eyelash. The artificial eyelash includes an artificial eyelash main body; and an annular member for coupling the artificial eyelash main body and the eyelash. The annular member is formed of a shrinkable material.

In a preferable embodiment, the artificial eyelash main body is an eyelash extension.

In a preferable embodiment, the annular member is formed of a thermally shrinkable material shrinkable by heat.

In a preferable embodiment, the annular member is formed of a rubber material.

In a preferable embodiment, the artificial eyelash main body and the annular member are integral.

In a preferable embodiment, a plurality of the annular members are provided for one artificial eyelash.

In a preferable embodiment, the artificial eyelash main body is formed of a colored resin.

In a preferable embodiment, the artificial eyelash main body is formed of a natural resin.

In a preferable embodiment, the artificial eyelash main body contains silver ions.

A method for attaching an artificial eyelash in an embodiment according to the present invention includes the steps of preparing an artificial eyelash main body and an annular member formed of a shrinkable material; locating the artificial eyelash main body near an eyelash; locating a portion of the artificial eyelash main body overlapping the eyelash in an opening of the annular member; and shrinking the annular member to fix the artificial eyelash main body and the eyelash.

In a preferable embodiment, the annular member is formed of a thermally shrinkable resin film shrinkable by heat; and in the step of fixing the artificial eyelash main body and the eyelash, the annular member is shrunk by heat from a heater, thereby coupling the artificial eyelash main body and the eyelash.

In a preferable embodiment, in the step of locating a portion of the artificial eyelash main body overlapping the eyelash, the artificial eyelash main body is temporarily attached to at least one of the eyelash and the annular member by use of a liquid.

In a preferable embodiment, the artificial eyelash main body is an eyelash extension.

In a preferable embodiment, the artificial eyelash main body and the annular member are integral.

In a preferable embodiment, in the step of fixing the artificial eyelash main body and the eyelash, the artificial eyelash main body and the eyelash are fixed with no use of glue.

An eyelash extension in an embodiment according to the present invention is an eyelash extension for increasing a length of an eyelash. The eyelash extension includes an artificial eyelash main body; and grooves formed in the artificial eyelash main body. The artificial eyelash main body includes a root portion contactable with the eyelash and a tip portion located opposite to the root portion; and the root portion has a polygonal cross-section which has at least five apexes and grooves located between the apexes.

In a preferable embodiment, the grooves are formed to extend in an extending direction of the artificial eyelash main body; and the grooves extend from the root portion to at least a middle point, which is located in the middle between an end face of the root portion and the tip portion.

In a preferable embodiment, the apexes of the cross-section are located at apexes of a regular octagon, and the grooves are located between the apexes of the regular octagon.

In a preferable embodiment, tips of the apexes are rounded.

In a preferable embodiment, the artificial eyelash main body contains silver ions.

An eyelash extension in an embodiment according to the present invention is an eyelash extension for increasing a length of an eyelash. The eyelash extension includes an artificial eyelash main body including a root portion contactable with the eyelash and a tip portion located opposite to the root portion. The root portion has a coarse surface portion.

In a preferable embodiment, the coarse surface portion is formed on the entirety of the artificial eyelash main body.

In a preferable embodiment, the coarse surface portion includes a plurality of particle-like convexed and concaved portions.

In a preferable embodiment, the coarse surface portion includes convexed and concaved portions formed by frosting.

In a preferable embodiment, the coarse surface portion includes convexed and concaved portions formed of a plurality of scratch-like grooves.

In a preferable embodiment, the coarse surface portion includes convexed and concaved portions formed by rubbing with a file.

An artificial eyelash in an embodiment according to the present invention is an artificial eyelash for increasing a length of an eyelash. The artificial eyelash includes an artificial eyelash main body including a tip portion and an end portion; and an antibacterial material contained in the artificial eyelash main body. The end portion of the artificial eyelash main body has a diameter which is larger than a diameter of the tip portion.

In a preferable embodiment, the artificial eyelash main body is an eyelash extension.

In a preferable embodiment, the artificial eyelash main body is formed of a resin; the antibacterial material is silver ions; and the silver ions are dispersed in the resin.

In a preferable embodiment, the resin is polybutylene terephthalate; and the artificial eyelash main body has a circular cross-section.

A method for attaching an artificial eyelash in an embodiment according to the present invention includes the steps of preparing an artificial eyelash main body containing an antibacterial material; locating the artificial eyelash main body near an eyelash; and fixing the artificial eyelash main body and the eyelash.

In a preferable embodiment, in the step of fixing the artificial eyelash main body and the eyelash, the artificial eyelash main body is temporarily attached to the eyelash by use of a liquid.

According to the artificial eyelash of the present invention, the artificial eyelash main body and the eyelash are coupled together by an annular member formed of a shrinkable material. Therefore, the artificial eyelash main body (e.g., an eyelash extension) can be attached to the eyelash with no use of glue.

The eyelash extension of the present invention includes an artificial eyelash main body and grooves formed in the artificial eyelash main body. The root portion of the artificial eyelash main body has a polygonal cross-section having at least five apexes and grooves located between the apexes. The grooves in such a polygonal shape of the artificial eyelash main body can easily hold the glue, and thus can improve the adhesiveness between the eyelash of the user and the artificial eyelash main body. Since the grooves are located between the apexes of the polygonal cross-section, the artificial eyelash main body can be bonded to the eyelash by use of the grooves holding the glue, not only in one direction but in other directions.

The artificial eyelash main body has a plurality of grooves. Therefore, the weight of the eyelash extension can be decreased as compared with that of an eyelash extension with no groove. The eyelash extension is to be attached to the eyelash of the user. Therefore, although each eyelash extension is lightweight, decreasing the weight thereof influences how a user (wearer) feels when wearing the eyelash extension. The resultant eyelash extension is comfortable to wear.

Where the cross-section is octagonal, there are advantages that the interval of the grooves can be made appropriate and that it is relatively easy to produce the eyelash extension.

According to the eyelash extension of the present invention, the root portion of the artificial eyelash main body has a coarse surface portion. The coarse surface portion can easily hold the glue, and thus can improve the adhesiveness between the eyelash of the user and the artificial eyelash main body. In the case where the coarse surface portion is formed on the entirety of the circumference of the artificial eyelash main body, the glue can be applied to the coarse surface portion, not only in one direction but in other directions, to bond the artificial eyelash main body to the eyelash.

According to the artificial eyelash of the present invention, the artificial eyelash main body contains an antibacterial material. Therefore, the eyelash extension can be antibacterial owing to the antibacterial effect of the antibacterial material (e.g., silver ions).

DETAILED DESCRIPTION OF EMBODIMENTS

Figure 1:
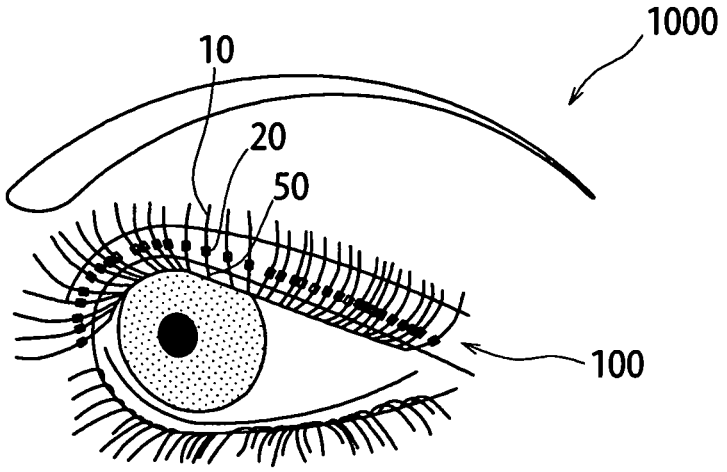
FIG. 1 shows artificial eyelashes 100 in an embodiment according to the present invention in an attached state.

The present inventor conceived from a different viewpoint from the technological common knowledge of the extension that the extension is bonded to the eyelash by use of glue. The extension could be bonded to the eyelash by use of nonirritating medical glue, but instead, the present inventor did active studies to develop a technique of attaching an extension with no use of glue and arrived at the structures of embodiments of the present invention.

Hereinafter, the embodiments of the present invention will be described with reference to the drawings. In the drawings referred to below, elements having substantially the same functions will be represented with the same reference numerals for simplifying the description. The present invention is not limited to the following embodiments.

<Embodiment 1>

Figure 2:
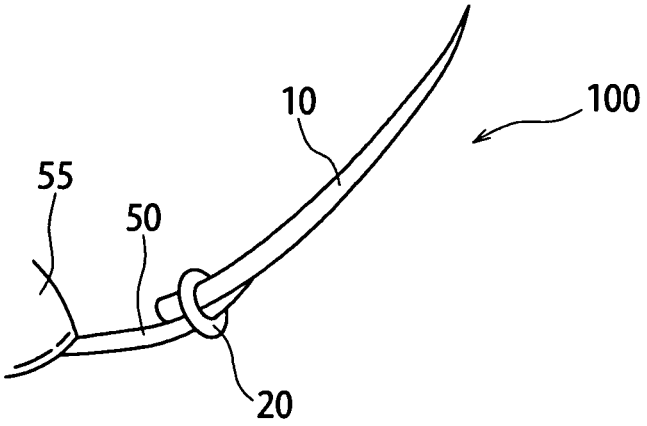
FIG. 2 shows a structure of one artificial eyelash 100 in the embodiment according to the present invention.

With reference to FIG. 1 and FIG. 2, an artificial eyelash 100 in an embodiment according to the present invention will be described. FIG. 1 shows a plurality of artificial eyelashes 100 in this embodiment which are attached to eyelashes 50 of a user 1000. FIG. 2 shows a structure of the artificial eyelash 100 in this embodiment.

The artificial eyelash 100 in this embodiment is for increasing a length of the eyelash 50 of the user 1000, and includes an artificial eyelash main body 10 and an annular member 20 for coupling the artificial eyelash main body 10 and the eyelash 50. The artificial eyelash main body 10 in this embodiment is an artificial eyelash extension. The annular member 20 in this embodiment is formed of a shrinkable material (e.g., thermally shrinkable resin material). The artificial eyelash main body 10 is attached to the eyelash 50 extending from skin 55 (in this example, a part of the eyelid) by the annular member 20 in a shrunk state.

Now, with reference to FIGS. 3(*a*) through (*c*), a method for attaching the artificial eyelash 100 in this embodiment will be described. Herein, the annular member before being shrunk (ring member) is represented by "22", and the annular member after being shrunk (tightening member or fixing member) is represented by "20" for the sake of convenience.

Figure 3A:
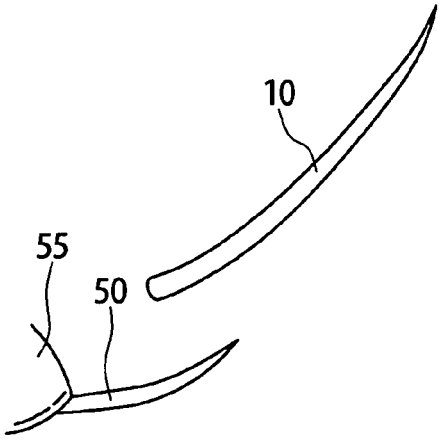
FIGS. 3(*a*) through (*c*) show steps of a method for attaching the artificial eyelash 100.
Figure 3B:
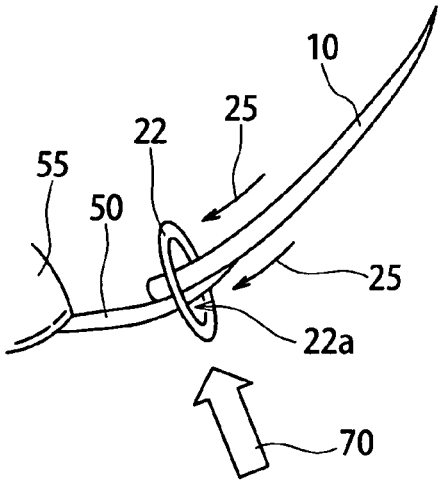
Figure 3C:
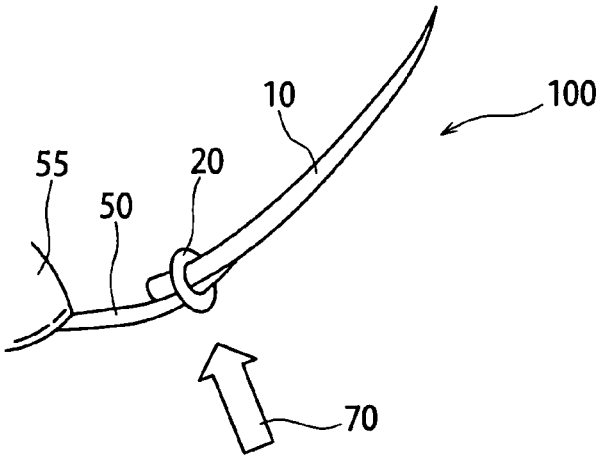

First, as shown in FIG. 3(*a*), the artificial eyelash main body 10, which is a main body of the artificial eyelash 100 in this embodiment, is located near the eyelash 50. The artificial eyelash main body 10 is picked up with, for example, tweezers and is located near the eyelash 50.

The artificial eyelash main body 10 in this embodiment is formed of, for example, a resin (typically, polybutylene terephthalate, polyester, acrylic resin, vinyl chloride, nylon). The artificial eyelash main body 10 has a length of, for example, 5 mm to 20 mm and a diameter (or thickness) of, for example, 0.07 mm to 0.3 mm. The artificial eyelash main body 10 may be formed of a black material or a different-colored material. The artificial eyelash main body 10 may be colored, for example, dark brown, purple, blue, pink, silver, green, light orange, light gold, red, wine red, white, yellow or the like, and thus can realize a color extension. The artificial eyelash main body 10, although so called, is for artificially increasing the length of the eyelash, and so may be formed of a natural material (e.g., animal-derived material, typically, human hair, animal hair (hair of mink, etc.) or silk; or plant-derived material, typically, cotton) instead of an artificial material (resin, etc.).

Next, as shown in FIG. 3(*b*), the artificial eyelash main body 10 is put into contact with a part of the eyelash 50 (e.g., a part from the center to the tip thereof), and the annular member 22 is located at a position where the eyelash 50 overlaps the artificial eyelash main body 10. The annular member 22 is formed of a thermally shrinkable material (e.g., vinyl chloride, polyolefin, polyethylene, polyethylene terephthalate, polystyrene). When being heated (as represented by arrow 70), the annular member 22 is shrunk. The annular member 22 may be formed a thermally shrinkable resin film which has been shaped like a ring.

In the example shown in FIG. 3(*b*), a part of the eyelash 50 and a part of the artificial eyelash main body 10 are located in an opening 22*a* of the annular member 22, and these elements are heated by use of a heating device (not shown) as represented by arrow 70. The heat may be from a dryer or any other source (e.g., a lamp, typically, a candescent lamp, an LED, etc.; a heater, etc.). In this example, the annular member 22 is outserted over the artificial eyelash main body 10 as represented by arrow 25, and then is set around the eyelash 50. Alternatively, the annular member 22 may be set around a part of the eyelash 50 (e.g., the tip thereof), and then a part of the artificial eyelash main body 10 may be inserted into the opening 22*a* of the annular member 22.

Next, the annular member 22 is heated to be shrunk as shown in FIG. 3(*c*). As a result, the shrunk annular member 20 couples the artificial eyelash main body 10 and the eyelash 50. Namely, heating of the annular member 22 causes the artificial eyelash main body 10 and the eyelash 50 to be fixed by the annular member 20.

According to the structure of this embodiment, the artificial eyelash main body 10 can be attached to the eyelash 50 by the annular member 20. Therefore, the artificial eyelash 100 attachable with no use of glue can be realized. In the above description, the artificial eyelash main body 10 is attached to the upper eyelash 50, but may be attached to a lower eyelash.

The inner diameter of the annular member 22 (diameter of the opening 22*a*) and the outer diameter of the annular member 22 may be determined to be preferable values in accordance with the form used. The inner diameter of the annular member 22 (diameter of the opening 22*a*) needs to be such that both of the eyelash 50 and the artificial eyelash main body 10 can be inserted thereto (e.g., 0.2 mm or greater). The diameter of the opening 22*a* also needs to be such that the annular member 22 after being heated and thus shrunk can bind the eyelash 50 and the artificial eyelash main body 10 (e.g., 1 mm or less).

Figure 4:
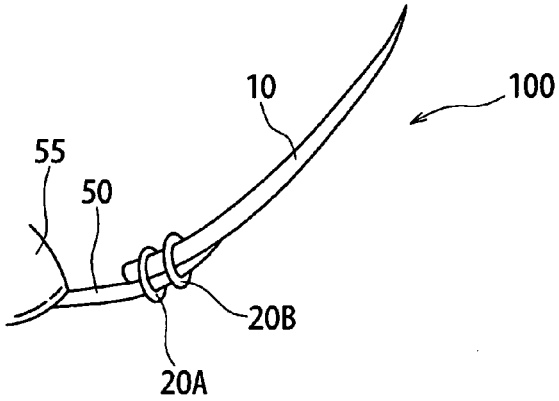
FIG. 4 shows an example in which two annular members 20 are provided to one eyelash 50.

In the above-described embodiment, one annular member 20 (or 22) is provided for one eyelash 50, but alternatively, a plurality of annular members 20 may be provided for one eyelash 50. In the example shown in FIG. 4, two annular members 20 (20A, 20B) are provided for one eyelash 50. Where a plurality of annular members 20 are provided like this, the attachment operation requires time and labor, but the bonding force of the eyelash 50 and the artificial eyelash main body 10 is increased and so the time until the artificial eyelash main body 10 is detached can be extended.

Figure 5:
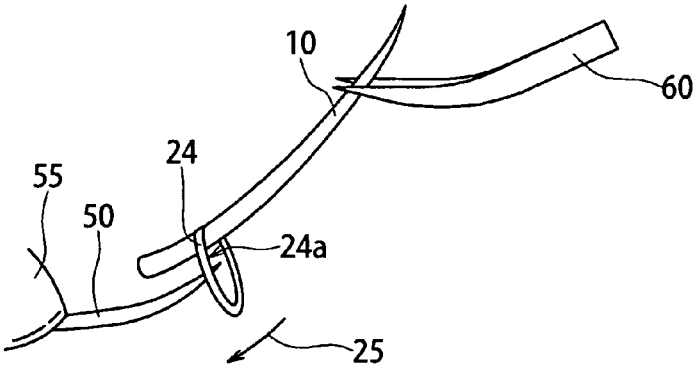
FIG. 5 shows an annular member 24 integrated with an artificial eyelash main body 10.
Figure 6:
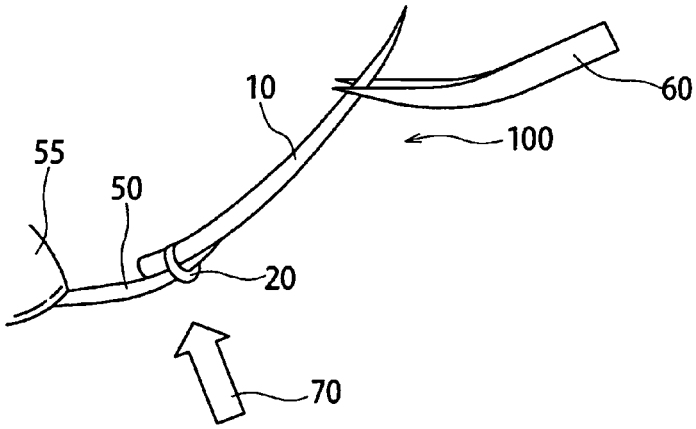
FIG. 6 shows how the artificial eyelash main body 10 is fixed by the annular member 20 integrated therewith.

According to the structure of the above-described embodiment, the artificial eyelash main body 10 and the annular member 20 (22) are independent elements. The present invention is not limited to this. As shown in FIG. 5, an annular member 24 integrated with the artificial eyelash main body 10 may be used. In this example, the artificial eyelash main body 10 with the annular member 24 is picked up with tweezers 60, and then a part of the eyelash 50 is inserted into an opening 24*a* of the annular member 24 as represented by arrow 25. Then, as shown in FIG. 6, the annular member 24 is heated to be shrunk by heat 70. Thus, the artificial eyelash main body 10 and the eyelash 50 can be fixed by the shrunk annular member 20.

As shown in FIG. 5, the artificial eyelash main body 10 integrated with the annular member 24 can be picked up and moved, and then the annular member 24 can be outserted over the eyelash 50. Such a structure is more convenient to attach the artificial eyelash 100 than the structure in which the annular member 22 and the artificial eyelash main body 10 are independent from each other. The artificial eyelash main body 10 integrated with the annular member 24 can be produced by, for example, mutual fusion of the annular member 24 and the artificial eyelash main body 10. Alternatively, the annular member 24 may be bonded to the artificial eyelash main body 10 by use of glue. A reason why glue can be used in this step is that since the glue is used for producing the artificial eyelash main body 10 integrated with the annular member 24 and is cured before the artificial eyelash main body 10 is attached, the risk that the glue influences the skin 55 of the user 1000 can be avoided.

Figure 7A:
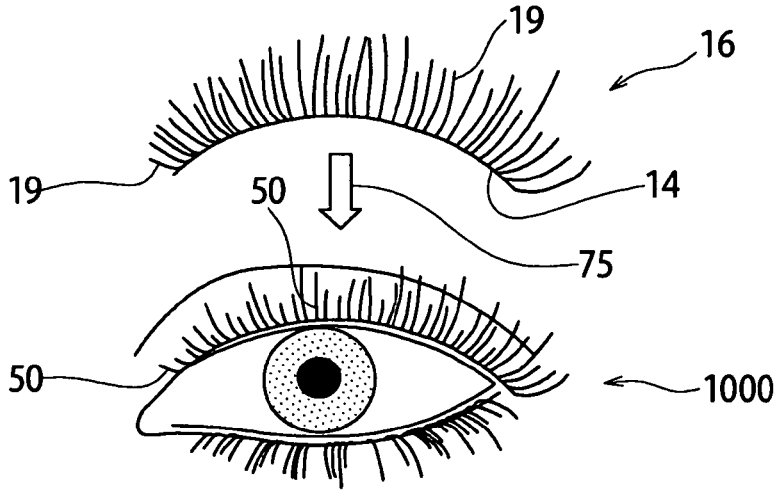
FIGS. 7(*a*) and (*b*) show a method for attaching an artificial eyelash main body 16 of a false eyelash type to the eyelashes 50.
Figure 7B:
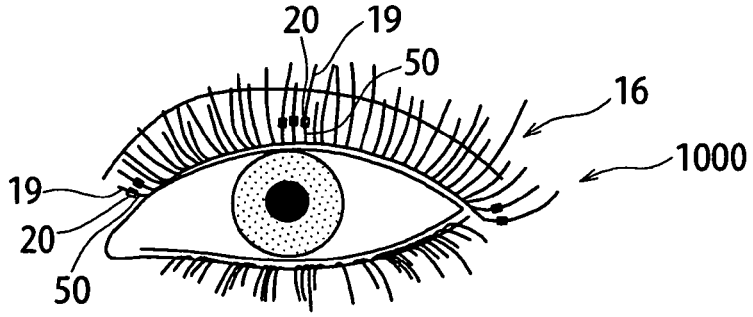

In the above-described embodiment, the artificial eyelash main body 10 is an eyelash extension. The present invention is not limited to this and is applicable to an artificial eyelash main body of a false eyelash type. FIGS. 7(*a*) and (*b*) show a method for attaching an artificial eyelash main body 16 of a false eyelash type to the eyelashes 50 of the user 1000.

First, as shown in FIG. 7(*a*), an artificial eyelash main body (false eyelash type) 16 including a support portion 14 and artificial eyelash portions 19 extending from the support portion 14 is prepared, and is located near the eyelashes 50 as represented by arrow 75. Then, as shown in FIG. 7(*b*), the artificial eyelash portions 19 of the artificial eyelash main body 16 and the eyelashes 50 are fixed by use of the annular members 20.

Figure 8:
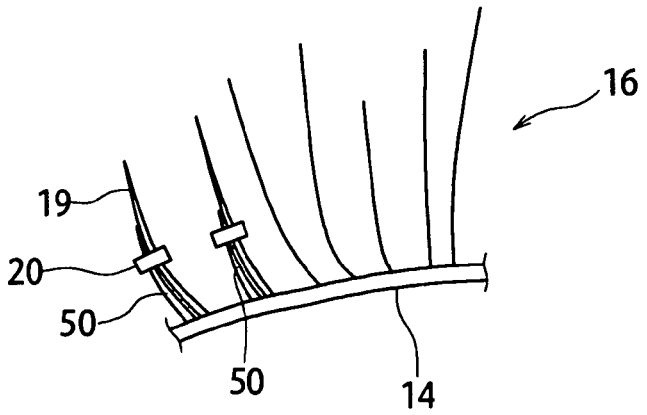
FIG. 8 is an enlarged view schematically showing how the artificial eyelash main body 16 is fixed by the annular members 20 at an end thereof.

In this embodiment, the annular members 20 are used at both of two ends and a central part of the artificial eyelash main body 16. More specifically, two annular members 20 are used at each of the two ends of the artificial eyelash main body 16, and three annular members 20 are used at the central part thereof. FIG. 8 is an enlarged view schematically showing how the annular members 20 fix the artificial eyelash portions 19 and the eyelashes 50 at an end of the artificial eyelash main body 16.

Figure 9A:
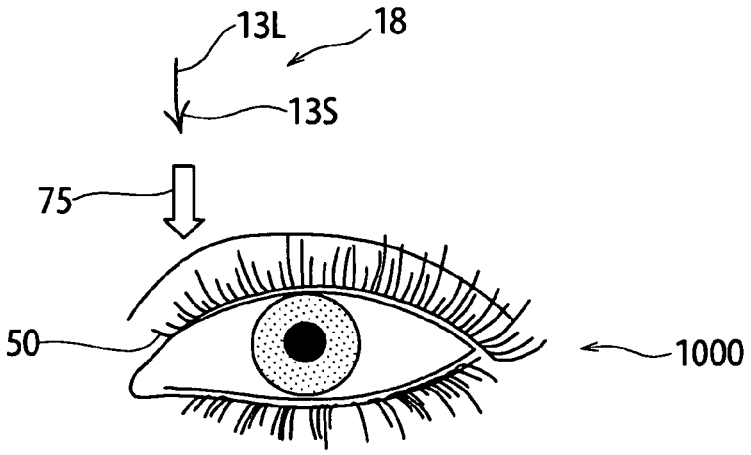
FIGS. 9(*a*) and (*b*) show a method for attaching a short false eyelash 18 to the eyelashes 50.
Figure 9B:
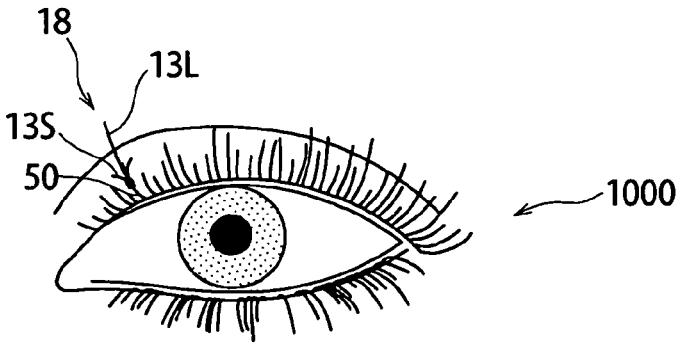

In addition, a short false eyelash (artificial eyelash main body) 18 as shown in FIGS. 9(*a*) and (*b*) may be attached to the eyelash 50 by the annular member 20. The short false eyelash 18 includes a plurality of artificial eyelash portions 13 (13L, 13S). The short false eyelash 18 shown in the figures includes three artificial eyelash portions 13, namely, one long portion 13L and two short portions 13S. As the number and lengths of the artificial eyelash portions, preferable values may be appropriately selected.

Figure 10:
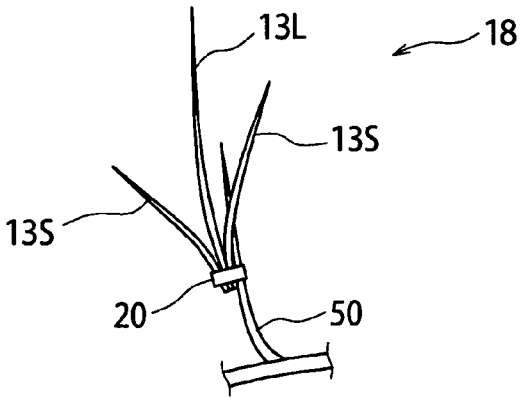
FIG. 10 shows how a root portion of the false eyelash 18 is fixed to the eyelash 50 by the annular member 20.
Figure 11:
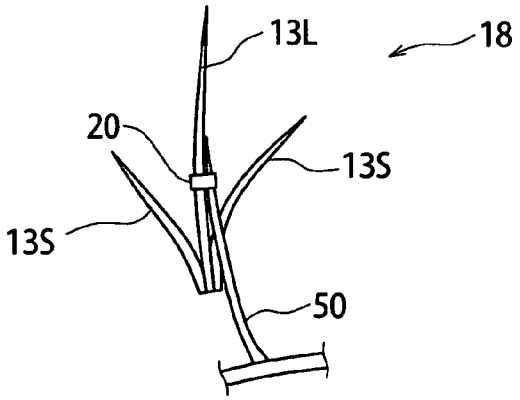
FIG. 11 shows how an artificial eyelash portion 13L of the false eyelash 18 is fixed to the eyelash 50 by the annular member 20.

First, as shown in FIG. 9(*a*), the short false eyelash 18 is prepared and located near the eyelash 50 as represented by arrow 75. Next, the short false eyelash 18 is fixed to the eyelash 50 by the annular member 20. For example, as shown in FIG. 10, a root portion of the short false eyelash 18 may be fixed to the eyelash 50 by the annular member 20; or as shown in FIG. 11, the artificial eyelash portion 13L of the false eyelash 18 may be fixed to the eyelash 50 by the annular member 20.

Figure 12:
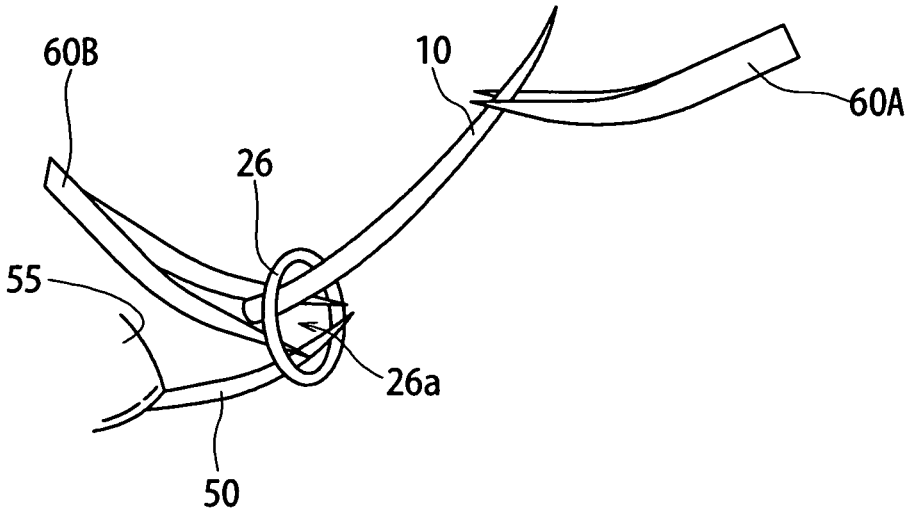
FIG. 12 shows how an artificial eyelash main body 10 is fixed to the eyelash 50 by use of an annular member 24 formed of a rubber material.

The annular member 20 (22) is described above as being formed of a thermally shrinkable material, but the present invention is not limited to this. The annular member 20 (22) may be formed of any other shrinkable material which can fix the artificial eyelash main body 10 (or 19, etc.) to the eyelash 50. For example, as shown in FIG. 12, the artificial eyelash main body 10 may be fixed to the eyelash 50 by use of an annular member 26 formed of an expandable rubber material (e.g., an expandable material such as silicone rubber or the like). In this case, while an opening 26*a* of the annular member 26 is expanded with tweezers 60B, the artificial eyelash main body 10 held with tweezers 60A is inserted into the expanded opening 26*a*. Then, when the tweezers 60B are detached, the annular member 26 is shrunk to fix both of the elements (10, 50).

Figure 13A:
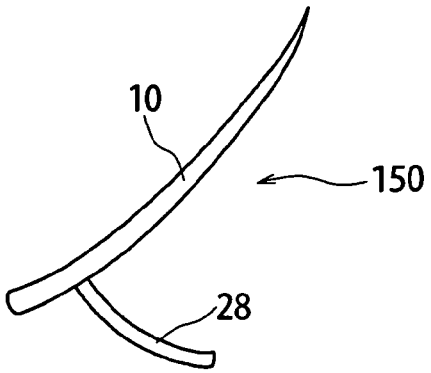
FIG. 13(*a*) shows a structure of an artificial eyelash 150, and FIG. 13(*b*) shows the artificial eyelash 150 which is attached to the eyelash 50.
Figure 13B:
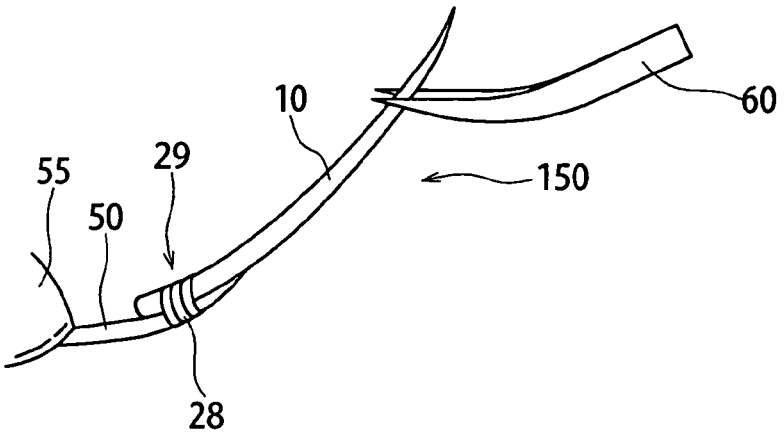

As shown in FIG. 13(*a*), this embodiment may be modified to an artificial eyelash (extension) 150 including a band-like portion 28 connected to a part of the artificial eyelash main body 10 (root portion). The band-like portion 28 of the extension 150 is formed of a shrinkable material (typically, a thermally shrinkable material). As shown in FIG. 13(*b*), the band-like portion 28 of the extension 150 is wound around the eyelash 50 to form an annular member 29. The annular member 29 is shrunk to fix the artificial eyelash main body 10 and the eyelash 50. In the above-described embodiment, the annular member 22 is shrunk by heat provided thereto, but alternatively, the annular member 22 may be shrunk by an ultrasonic energy provided thereto, instead of the heat. From the viewpoint of the annular member 22, provision of the ultrasonic energy is also considered to be provision of heat because the ultrasonic energy also vibrates the annular member 22. However, the technique of providing the ultrasonic energy has advantages that, for example, the hands of the operator do not feel hot or do not burn. For providing the ultrasonic energy, an element for generating ultrasonic waves is located at tips of the tweezers, an iron or tongs, and the annular member 22 is held between the tips to obtain an ultrasonic energy. In this manner, the annular member 22 can be shrunk.

This embodiment has been described by way of various examples. These examples do not limit the present invention, and the present invention can be modified in various manners, needless to say. For example, in the step shown in FIG. 3(*b*) or the like, at least two among (or all of) the artificial eyelash main body 10, the annular member 22, and the eyelash 50 can be temporarily attached together by use of a liquid (e.g., water or a liquid having a higher viscosity than that of water, typically, a liquid cosmetic material). Where the above-mentioned element (10 or 22) and the eyelash 50 can be temporarily attached together by use of such a liquid having a viscosity usable for temporary attachment (e.g., water or a liquid cosmetic material), the operation of the operator who attaches the artificial eyelash 100 may become easier. Even if a trace amount of glue is used for the temporary attachment, the glue does not cause any problem because the fixation of the elements is realized by the annular member 20. Even if medical glue is used as the glue for temporary attachment, the cost can still be reduced because the amount of the medical glue used here is very small.

<Embodiment 2>

Figure 14:
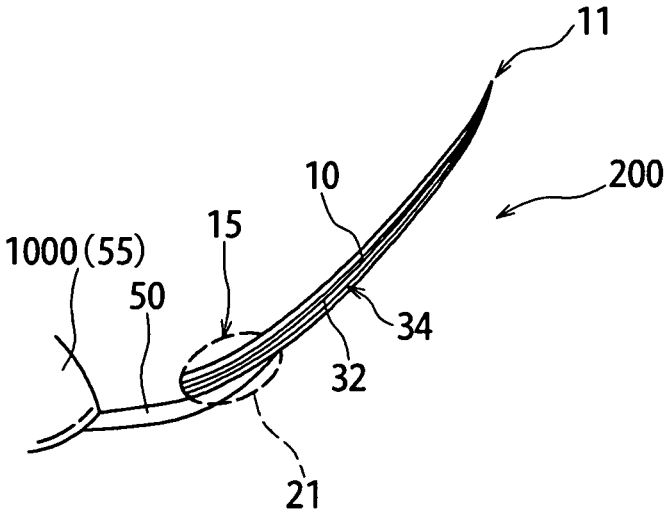
FIG. 14 shows an extension 200 in an embodiment according to the present invention in an attached state.

With reference to FIG. 14, an eyelash extension 200 in an embodiment according to the present invention will be described. FIG. 14 shows the eyelash extension 200 in this embodiment which is attached to an eyelash 50 of a user (wearer) 1000.

The eyelash extension 200 in this embodiment is for increasing the length of the eyelash 50 of the user 1000. In embodiments according to the present invention, an eyelash extension may be occasionally referred to as an "extension".

The extension 200 in this embodiment includes an artificial eyelash main body 10 and grooves 34 formed in the artificial eyelash main body 10. The artificial eyelash main body 10 includes a root portion 15 contactable with the eyelash 50 of the user 1000 and a tip portion 11 located opposite to the root portion 15. In this embodiment, the root portion 15 has a polygonal cross-section having at least five apexes 32 and the grooves 34 located between the apexes 32.

In the extension 200 in this embodiment, glue 21 is applied to the root portion 15. The extension 200 is bonded and thus fixed to the eyelash 50 with the glue 21.

Figure 15:
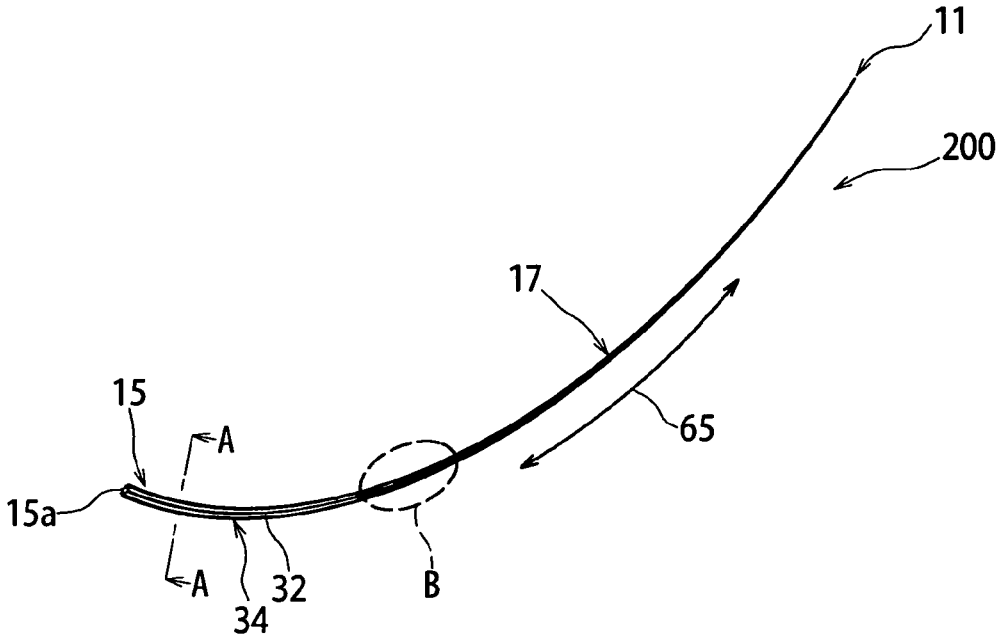
FIG. 15 is a perspective view showing a structure of the extension 200 in the embodiment according to the present invention.
Figure 16:
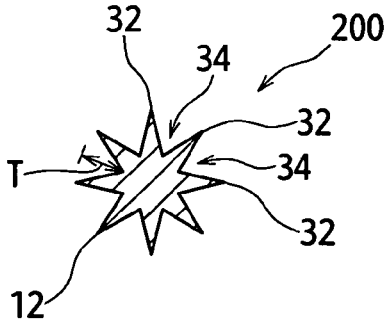
FIG. 16 is a cross-sectional view of the extension 200 taken along line A-A in FIG. 15.
Figure 17:
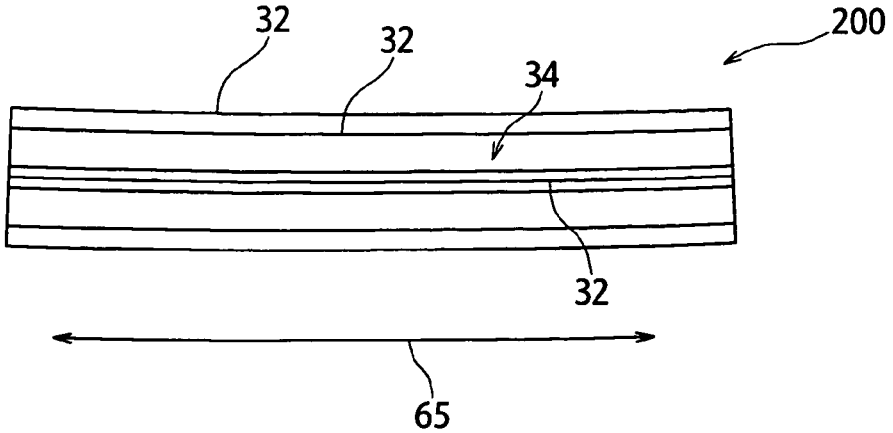
FIG. 17 is an enlarged view of part B of the extension 200 in FIG. 15.

FIG. 15 is a perspective view showing a structure of the extension 200 in this embodiment. FIG. 16 shows a cross-section taken along line A-A in FIG. 15. FIG. 17 shows an enlarged side view of part B in FIG. 15.

In the extension 200 in this embodiment, the grooves 34 extend in an extending direction 65 of the artificial eyelash main body 10. As shown in FIG. 16, the cross-section of the artificial eyelash main body 10 has a regular octagonal shape, with the grooves 34 being formed between the apexes 32. More specifically, the apexes 32 of the cross-section of the artificial eyelash main body 10 are located at apexes of the regular octagon. Thus, the apexes 32 are formed at every 45°. Regarding a part of the regular octagon between 0° and 90°, the apexes 32 are located at 0°, 45° and 90°, and a groove 34 is located between the apexes at 0° and 45° and another groove 34 is located between the apexes at 45° and 90°.

The artificial eyelash main body 10 in this embodiment has a shape in which the root portion 15 is thick and becomes thinner toward the tip portion 11. The artificial eyelash main body 10 in this embodiment is formed of, for example, a resin (typically, polybutylene terephthalate, polyester, acrylic resin, vinyl chloride, nylon). The artificial eyelash main body 10 has a length of, for example, 5 mm to 20 mm and a diameter (or thickness) of, for example, 0.07 mm to 0.3 mm.

The artificial eyelash main body 10 may be formed of a black material or a different-colored material. The artificial eyelash main body 10 may be colored, for example, dark brown, purple, blue, pink, silver, green, light orange, light gold, red, wine red, white, yellow or the like, and thus can realize a color extension. The artificial eyelash main body 10, although so called, is for artificially increasing the length of the eyelash, and so may be formed of a natural material (e.g., animal-derived material, typically, human hair, animal hair (hair of mink, etc.) or silk; or plant-derived material, typically, cotton) instead of an artificial material (resin, etc.).

Each of the grooves 34 formed in the artificial eyelash main body 10 may have a depth T of, for 20 to 40 (typically, 30) where the thickness of the artificial eyelash main body 10 is 100. According to the structure of this embodiment, the grooves 34 are formed from an end face 15*a* of the root portion 15 to the tip portion 11. However, the grooves 34 do not need to be formed up to the very tip of the tip portion 11 and merely need to be formed in at least the root portion 15. A reason for this is that where the extension 200 is produced by a certain method, the grooves 34 may disappear in the tip portion 11 having a smaller diameter.

In the extension 200 in this embodiment, the grooves 34 can extend from the root portion 15 to, for example, a middle point 17, which is located in the middle between the end face 15*a* of the root portion 15 and the tip portion 11. Where the extension 200 is produced by a certain method, a part of the artificial eyelash main body 10 may melt to disappear at the position of the end face 15*a* of the root portion 15. Therefore, even where the grooves 34 are formed in the root portion 15, it is not absolutely necessary that the grooves 34 are formed at the position of the end face 15*a* of the root portion 15.

Now, with reference to FIGS. 18(*a*) through (*c*), a method for attaching the extension 200 in this embodiment to the eyelash 50 will be described.

Figure 18A:
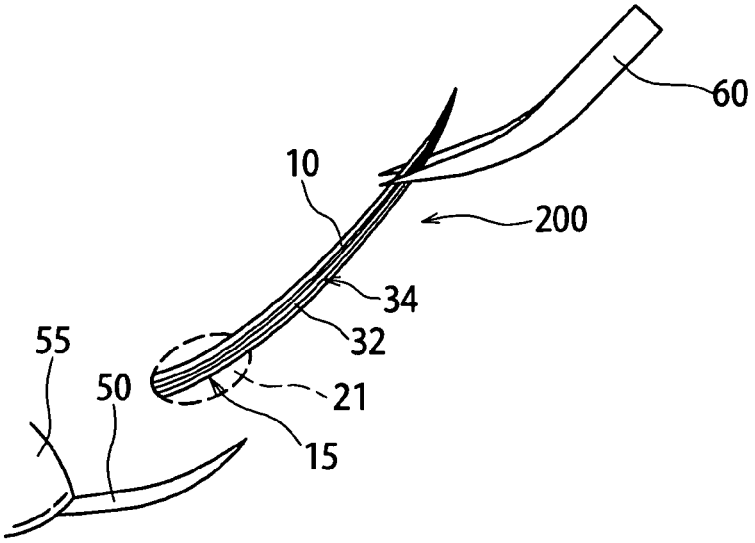
FIGS. 18(*a*) through (*c*) show a method for attaching the extension 200 to the eyelash 50.
Figure 18B:
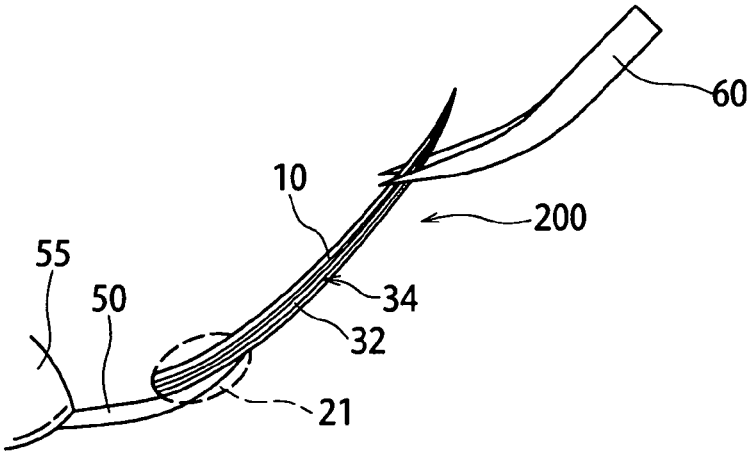
Figure 18C:
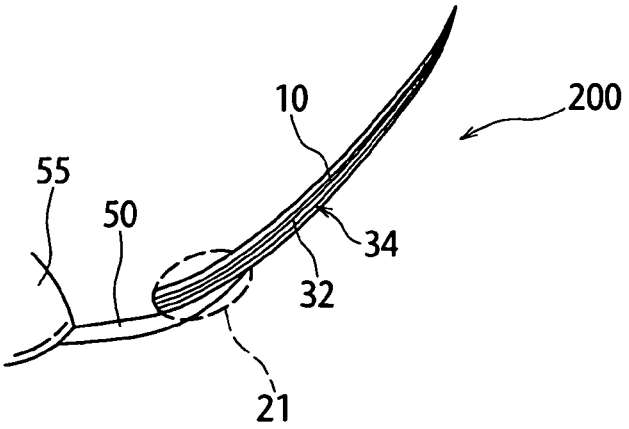

First, as shown in FIG. 18(*a*), a part of the extension 200 is picked up with the tweezers 60, and the extension 200 is located near the eyelash 50 in the state where the glue 21 is applied to the root portion 15.

Next, as shown in FIG. 18(*b*), the glue 21 of the extension 200 is attached to the eyelash 50 and the extension 200 is put into close contact with the eyelash 50. When the glue 21 is cured to fix the extension 200 to the eyelash 50, as shown in FIG. 18(*c*), the tweezers 60 are detached. Thus, the attachment of the extension 200 is completed. This operation is conducted for each eyelash 50.

In the extension 200 in this embodiment, the root portion of the artificial eyelash main body 10 has a polygonal cross-section having the grooves 34 between the apexes 32. The grooves 34 in such a polygonal shape of the artificial eyelash main body 10 can easily hold the glue 21, and thus can improve the adhesiveness between the eyelash 50 of the user and the artificial eyelash main body 10. Since the grooves, 34 are located between the apexes 32 of the polygonal cross-section, the artificial eyelash main body 10 can be bonded to the eyelash 50 by use of the grooves 34 holding the glue, not only in one direction but in other directions. As compared with an extension having a C-shaped recessed portion in one direction, the extension 200 can be attached to the eyelash 50 more easily.

The artificial eyelash main body 10 has a plurality of grooves 34. Therefore, the weight (mass) of the extension 200 can be decreased as compared with that of an extension with no groove 34. The extension 200 is to be attached to the eyelash of the user. Therefore, although each extension 200 is lightweight, decreasing the weight thereof influences how the user 1000 feels when wearing the extension 200. The resultant extension 200 is comfortable to wear. The extension 200 in this embodiment, although depending on the thickness of the artificial eyelash main body 10 or the depth T of the grooves 34, can be decreased in weight by, for example, 10% to 70% as compared with an extension with no groove 34.

Figure 19:
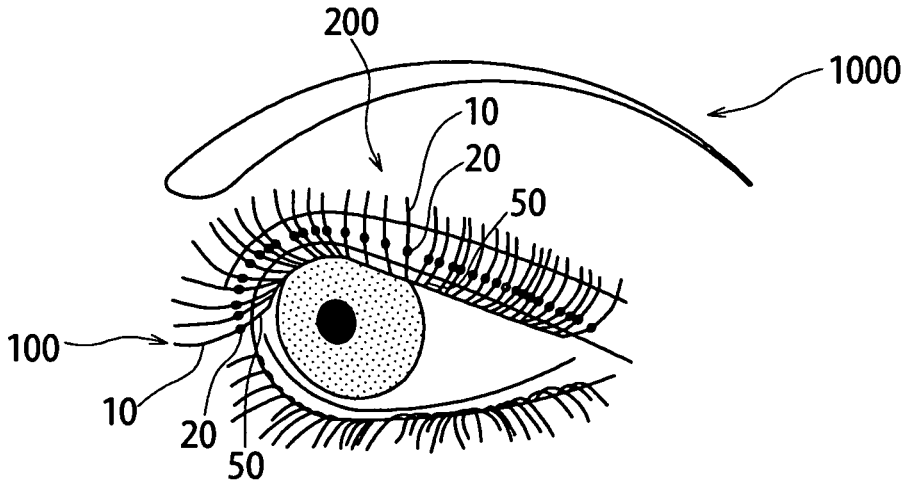
FIG. 19 shows the extensions 200 which are attached to upper eyelashes 50.

FIG. 19 shows the extensions 200 which are attached to the upper eyelashes 50. As shown in FIG. 19, the extensions 200 are attached to many eyelashes 50. The extension 200 in this embodiment allows the artificial eyelash main body 10 to be attached to the eyelash 50 easily owing to the plurality of grooves 34 formed in the artificial eyelash main body 10. Therefore, the operation of attaching many extensions 200 can be made more easily as compared with the case of a conventional extension with no groove.

In addition, the extension 200 in this embodiment is more lightweight than a conventional extension with no groove. Therefore, even where many extensions 200 are attached to the eyelashes 50, the user 1000 feels lighter as compared with the conventional extension. Namely, the extension 200 in this embodiment can give a sense of lightness, which cannot be provided by the conventional extension, to the user 1000.

The extension 200 in this embodiment as shown in FIG. 15 and FIG. 16 can be produced as follows, for example. First, a resin is extruded from a mold having an opening of the cross-sectional shape as shown in FIG. 16 to produce a fibriform member having the apexes 32 and the grooves 34. Next, the fibriform member is cut so as to have the length of the artificial eyelash main body 10. Then, a part of the artificial eyelash main body 10 obtained as a result of the cutting is immersed in a chemical to make the tip portion 11 of the artificial eyelash main body 10 thinner than the remaining part thereof. Thus, the extension 200 in this embodiment can be produced. The artificial eyelash main body 10 having a cross-section in which the apexes 32 are located at apexes of a regular octagon as shown in FIG. 16 is convenient because the mold can be produced such that the apexes 32 are located at an interval of 45°.

For producing the extension 200 in this embodiment using a natural material, the artificial eyelash main body 10 formed of such a natural material may be processed to have the grooves 34 by use of a cutting tool or the like.

Figure 20:
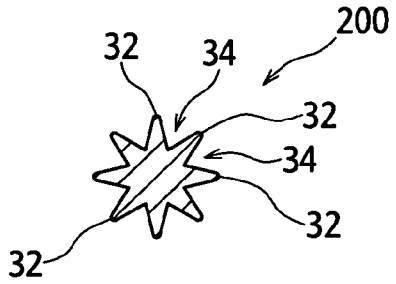
FIG. 20 is a cross-sectional view showing a modification of the extension 200.

The extension 200 in this embodiment may be modified as follows. In the extension 200 shown in FIG. 16, the apexes 32 of the cross-section are pointed. Alternatively, as shown in FIG. 20, the apexes 32 may be rounded.

Figure 21:
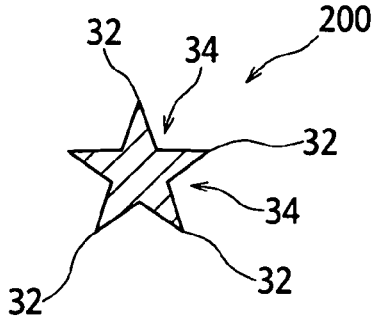
FIG. 21 is a cross-sectional view showing a modification of the extension 200.
Figure 22:
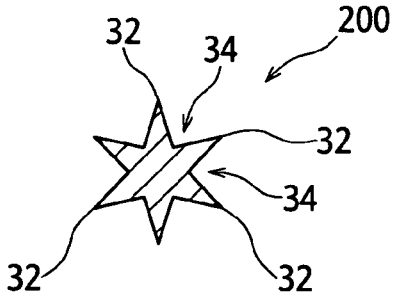
FIG. 22 is a cross-sectional view showing a modification of the extension 200.

In the extension 200 shown in FIG. 16, the apexes 32 of the cross-section are located at apexes of an octagon (especially, a regular octagon). Alternatively, as shown in FIG. 21, the apexes 32 of the cross-section may be located at apexes of a pentagon (especially, a regular pentagon). Still alternatively, as shown in FIG. 22, the apexes 32 of the cross-section may be located at apexes of a hexagon (especially, a regular hexagon). It is preferable that the apexes 32 of the cross-section are located at apexes of a regular polygon (a regular octagon, etc.) because the grooves 34 are located equidistantly and thus the extension 200 has a preferable shape and structure. It is preferable that the grooves 34 are located equidistantly because even when the weight is decreased, a relatively high strength can be maintained.

<Embodiment 3>

Figure 23:
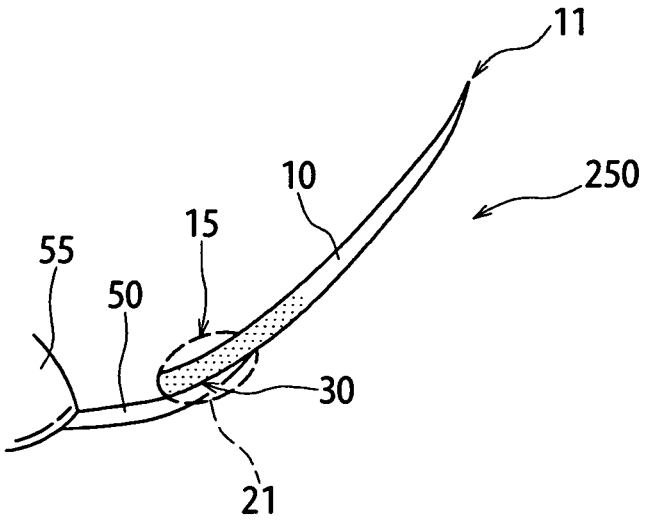
FIG. 23 shows an extension 250 in an embodiment according to the present invention in an attached state.

With reference to FIG. 23, an eyelash extension 250 in an embodiment according to the present invention will be described. FIG. 23 shows the artificial eyelash 250 in this embodiment which is attached to an eyelash 50 of a user (wearer).

The extension 250 in this embodiment includes an artificial eyelash main body 10. The artificial eyelash main body 10 in this embodiment includes a root portion 15 contactable with the eyelash 50 and a tip portion 11 located opposite to the root portion 15. According to the structure of this embodiment, the root portion 15 has a coarse surface portion 30.

In the extension 250 in this embodiment, glue 21 is applied to the root portion 15. The extension 250 is bonded and thus fixed to the eyelash 50 with the glue 21. Specifically, the glue 21 is applied to the coarse surface portion 30 of the root portion 15, and the extension 250 (or the artificial eyelash main body 10) is attached to the eyelash 50 with the glue 21.

Figure 24:
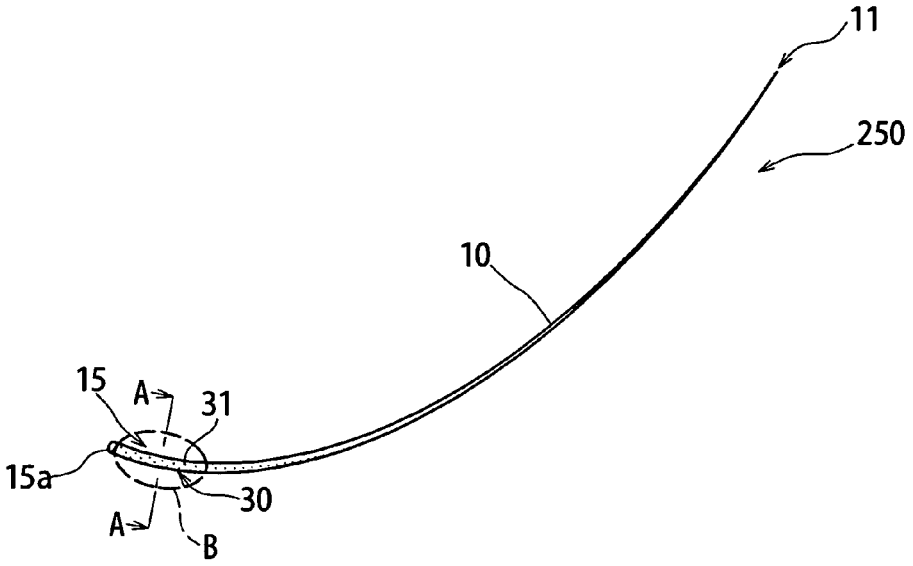
FIG. 24 is a perspective view showing a structure of the extension 250 in the embodiment according to the present invention.
Figure 25:
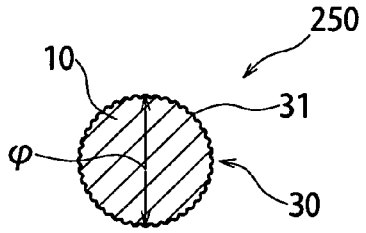
FIG. 25 is a cross-sectional view of the extension 200 taken along line A-A in FIG. 24.
Figure 26:
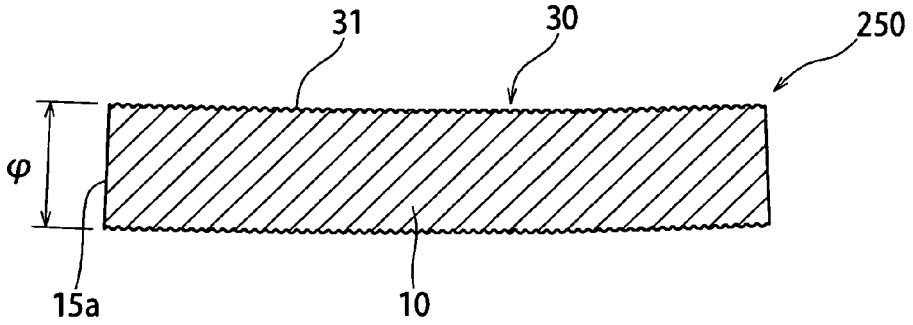
FIG. 26 is an enlarged view of part B of the extension 250 in FIG. 24.

FIG. 24 is a perspective view showing a structure of the extension 250 in this embodiment. FIG. 25 shows a cross-section taken along line A-A in FIG. 24. FIG. 26 shows an enlarged side view of part B in FIG. 24.

In the extension 250 in this embodiment, the coarse surface portion 30 is formed on the end face 15*a* side of the root portion 15 with respect to a middle point of the artificial eyelash main body 10 in a longitudinal direction thereof. Especially, the coarse surface portion 30 merely needs to be formed in an area to be in contact with the eyelash 50, and may be selectively formed only in an area on which the glue 21 is to be applied.

The coarse surface portion 30 in this embodiment includes a plurality of particle like convexed and concaved portions 31. The coarse surface portion 30 formed of the particle-like convexed and concaved portions 31 is formed on the entirety of a circumference of the root portion 15. Accordingly, the root portion 15 has the coarse surface portion 30 in all the azimuths of the surface thereof. In whichever direction the glue 21 may be applied to the root portion 15, the glue 21 can be applied to the coarse surface portion 30.

Like in the above-described embodiments, the artificial eyelash main body 10 in this embodiment has a shape in which the root portion 15 is thick and becomes thinner toward the tip portion 11. The artificial eyelash main body 10 in this embodiment is formed of, for example, a resin (typically, polybutylene terephthalate, polyester, acrylic resin, vinyl chloride, nylon). The artificial eyelash main body 10 has a length of, for example, 5 mm to 20 mm and a diameter ϕ (or thickness) of, for example, 0.07 mm to 0.3 mm.

According to the structure of this embodiment, the coarse surface portion 30 of the artificial eyelash main body 10 is formed by frosting. In other words, the artificial eyelash main body 10 has the convexed and concaved portions 31 provided by frosting. "Frosting" is a type of processing of making a surface coarse like frost (or like frosted glass). In this embodiment, the convexed and concaved portions 31 are formed on the artificial eyelash main body 10 by sandblast. "Sandblast" is a type of processing of blowing an abrasive such as sand or the like to a surface. For example, compressed air provided by a compressor and containing an abrasive mixed therein is blown to the root portion 15 of the artificial eyelash main body 10, and thus the coarse surface portion 30 can be formed on the root portion 15. The "sand" (abrasive) used for sandblast is not limited to so-called sand and may be any abrasive suitable to form the convexed and concaved portions 31 on the artificial eyelash main body 10.

The depth of the convexed and concaved portions 31 (difference between the top of the convexed portions and the bottom of the concaved portions) in this embodiment is, for example, about 0.01 mm to 0.1 mm, but is not limited to such a range. Specifically, the depth is determined based on the conditions of frosting (e.g., sandblast) used for forming the coarse surface portion 30. In accordance with the type of frosting used, preferable convexed and concaved portions 31 can be appropriately formed.

Alternatively, the coarse surface portion 30 may be formed by through-holes which are formed in the artificial eyelash main body 10. In this case, the length of the through-holes which form the convexed and concaved portions 31 correspond to the diameter ϕ of the artificial eyelash main body 10. Formation of the through-holes also provides an advantage that the weight (mass) of the extension 250 can be decreased. The extension 250 is to be attached to the eyelash of the user. Therefore, although each extension 250 is lightweight, decreasing the weight thereof influences how a user (wearer) feels when wearing the extension 250. The resultant extension 250 is comfortable to wear.

The coarse surface portion 30 in this embodiment can be formed by rubbing the root portion 15 with a file (specifically, sandpaper). Sandpaper is a tool used for polishing and is obtained by applying an abrasive to a paper-like sheet. In the case where the coarse surface portion 30 is formed by use of sandpaper, the shape, depth and the like of the convexed and concaved portions 31 of the coarse surface portion 31 can be adjusted by the roughness (count) of the sandpaper to be used.

For forming the coarse surface portion 30 on the root portion 15 of the artificial eyelash main body 10, it is advisable to align many artificial eyelash main bodies 10 and sandblast the root portions 15. This way, many artificial eyelash main bodies 10 having the coarse surface portions 30 can be formed in one cycle of processing. It is also advisable to align many artificial eyelash main bodies 10 and rub the root portions 15 with sandpaper. This way also, many artificial eyelash main bodies 10 having the coarse surface portions 30 can be formed in one cycle of processing. Needless to say, one artificial eyelash main body 10 may be rubbed with sandpaper to form the coarse surface portion 30.

The extension 250 in this embodiment can be attached to the eyelash 50 by substantially the same method as shown in FIGS. 18(*a*) through (*c*).

In the extension 250 in this embodiment, the root portion 15 of the artificial eyelash main body 10 has the coarse surface portion 30. The coarse surface portion 30 can easily hold the glue 21, and thus can improve the adhesiveness between the eyelash 50 of the user and the artificial eyelash main body 10. A conventional extension has a smooth surface and so glue does not stay necessarily well thereon. The extension 250 in this embodiment holds the glue 21 in a better manner because a surface area size thereof is increased by the coarse surface portion 30 (or the convexed and concaved portions 31) as compared with a smooth surface, and therefore allows the glue 21 to stay thereon well.

The surface area size increased by the coarse surface portion 30 improves the force of holding the glue 21. It is preferable that the coarse surface portion 30 is formed in an area larger than the area to which the glue 21 is to be applied. Even if the coarse surface portion 30 is formed in an area smaller than the area to which the glue 21 is to be applied, it does not cause any problem because the coarse surface portion 30 can hold the glue 21 in a good manner.

Recently, there are cases where glue having a relatively weak adhesive force needs to be used because strong glue cannot be used in consideration of the rash or allergy of the skin of the users or other influences of an organic solvent. In such cases, a conventional extension cannot cause glue to stay on well, which may possibly hinder the operation of attaching the extension. By contrast, the extension 250 in this embodiment allows the glue 21 to stay on well, and so suppresses the problem even where glue having a relatively weak adhesive force is used.

In the extension 250 in this embodiment, the coarse surface portion 30 is formed on the entirety of a circumference of the artificial eyelash main body 10. Therefore, the glue 21 can be applied to the coarse surface portion 30, not only in one direction but in other directions, to bond the artificial eyelash main body 10 to the eyelash 50. As compared with an extension having a C-shaped recessed portion in one direction; the extension 250 can be attached to the eyelash 50 more easily.

The extension 250 in this embodiment may be modified as follows. In the extension 250 shown in FIG. 23, the coarse surface portion 30 is selectively formed on the root portion 15 of the artificial eyelash main body 10. Alternatively, the coarse surface portion 30 may be formed on the entirety of the artificial eyelash main body 10. In the case where the coarse surface portion 30 is formed on the entirety of the artificial eyelash main body 10 also, the glue 21 can be applied to the root portion 15 of the artificial eyelash main body 10 to attach the artificial eyelash main body 10 to the eyelash 50, needless to say.

The extension 250 in this embodiment as shown in FIG. 24 and FIG. 25 can be produced as follows, for example. First, a resin is extruded from a mold having an opening of a circular cross-section to produce fibriform members having an identical diameter ϕ. Next, the fibriform members are cut so as to have the length of the artificial eyelash main body 10. Then, a part of each artificial eyelash main body 10 obtained as a result of the cutting is immersed in a chemical to make the tip portion 11 of the artificial eyelash main body 10 thinner than the remaining part thereof. In the case where the artificial eyelash main body 10 is frosted to form the coarse surface portion 30 on the entirety of the artificial eyelash main body 10 before being partially immersed in the chemical, when the part (tip portion) of the artificial eyelash main body 10 is immersed in the chemical, the coarse surface portion 30 may disappear from that part. In this case, the artificial eyelash main body 10 has the coarse surface portion 30 on the root portion 15 (or the vicinity thereof) thereof.

Alternatively, the artificial eyelash main body 10 may be frosted to form the coarse surface portion 30 on the entirety of the artificial eyelash main body 10 after the tip portion 11 thereof is made thinner. In this case, the extension 250 having the coarse surface portion 30 on the entirety thereof can be obtained. Even after the tip portion 11 of the artificial eyelash main body 10 is made thinner, if the artificial eyelash main body 10 is frosted with the tip portion 11 (or the portion excluding the root portion 15) being masked, the coarse surface portion 30 can be formed on the root portion 15 of the artificial eyelash main body 10.

The coarse surface portion 30 may or may not be formed on the end face 15*a* of the root portion 15. According to the structure of this embodiment, as shown in FIG. 25, the coarse surface portion 30 (convexed and concaved portions 31) is formed on the entire circumference of the root portion 15. Alternatively, the circumference of the root portion 15 may have an area where the coarse surface portion 30 (convexed and concaved portions 31) is not formed. For example, the coarse surface portion 30 (convexed and concaved portions 31) may be formed in four areas (at an interval of 90°) or eight areas (at an interval of 45°) instead of the entire circumference of the root portion 15. Even with the structure in which the coarse surface portion 30 (convexed and concaved portions 31) is formed in four areas (at an interval of 90°) or eight areas (at an interval of 45°), the glue 21 can be applied to the root portion 15 in a plurality of directions, not in one direction, and thus the glue 21 can stay on the root portion 15 well.

The extension 250 in this embodiment may also be modified as follows. In the extension 250 shown in FIG. 27, convexed and concaved portions 33 formed of a plurality of scratch-like grooves are formed on the root portion 15 of the artificial eyelash main body 10. In other words, a coarse surface portion 35 including the convexed and concaved portions 33 formed of scratch-like grooves is formed on the artificial eyelash main body 10.

The convexed and concaved portions 33 formed of a plurality scratch-like grooves can be provided by scratching the surface of the artificial eyelash main body 10 by use of a device including an array of tiny cutting tools. Alternatively, the convexed and concaved portions 33 formed of a plurality of scratch-like grooves may be provided by rubbing the artificial eyelash main body 10 with sandpaper in a certain manner. Specifically, the convexed and concaved portions 33 formed of a plurality scratch-like grooves can be provided by rubbing the artificial eyelash main body 10 with sandpaper such that the tiny grooves (short linear grooves) are not connected to each other.

Figure 27:
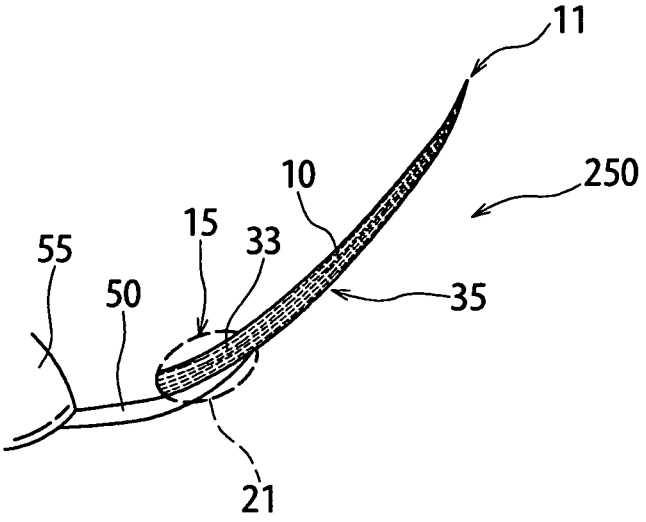
FIG. 27 is a cross-sectional view showing a modification of the extension 250.

In the extension 250 shown in FIG. 27, the convexed and concaved portions 33 are formed on the entirety of the artificial eyelash main body 10. Alternatively, the convexed and concaved portions 33 formed of scratch-like grooves (or scratches) may be formed on the root portion 15 (or the vicinity thereof).

In the extension 250 shown in FIG. 27 also, the coarse surface portion 35 can easily hold the glue 21, and thus can improve the adhesiveness between the eyelash 50 of the user and the artificial eyelash main body 10. In addition, in the example shown in FIG. 27, the coarse surface portion 35 are formed on the entire circumference of the artificial eyelash main body 10. Therefore, the glue 21 can be applied to the coarse surface portion 35, not only in one direction but in other directions, to bond the artificial eyelash main body 10 to the eyelash 50. As compared with an extension having a C-shaped recessed portion in one direction, the extension 250 can be attached to the eyelash 50 more easily.

When the extension 250 is attached to each upper eyelash 50, substantially the same state as that shown in FIG. 19 is obtained. The extensions 250 are attached to many eyelashes 50. The extension 250 in this embodiment allows the artificial eyelash main body 10 to be attached to the eyelash 50 easily by use of the coarse surface portion 30 (or 35) formed on the artificial eyelash main body 10. Therefore, the operation of attaching many extensions 250 can be made more easily as compared with the case of a conventional extension having a smooth surface.

This embodiment has been described by way of preferable examples. These examples do not limit the present invention, and the present invention can be modified in various manners, needless to say.

<Embodiment 4>

Figure 28:
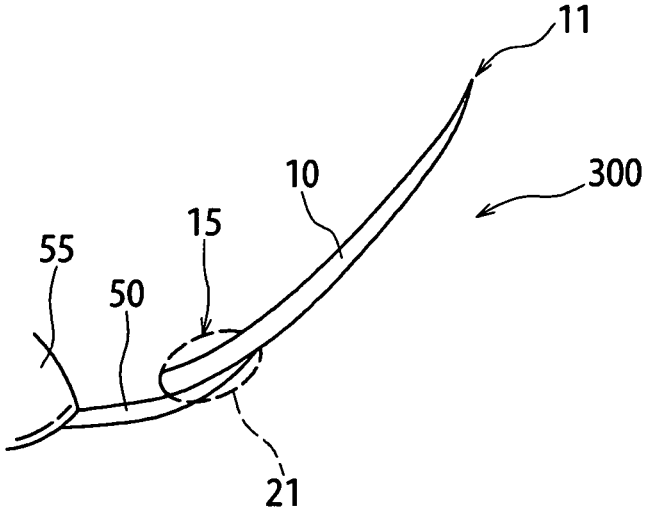
FIG. 28 shows an extension 300 in an embodiment according to the present invention in an attached state.

With reference to FIG. 28, an eyelash extension 300 in an embodiment according to the present invention will be described. FIG. 28 shows the eyelash extension 300 in this embodiment which is attached to the eyelash 50 of a user (wearer).

The extension 300 in this embodiment includes an artificial eyelash main body 10 and silver ions ($Ag^+$) contained in the artificial eyelash main body 10. The artificial eyelash main body 10 has a shape of an eyelash. Specifically, an end portion 15 of the artificial eyelash main body 10 has a diameter which is larger than a diameter of a tip portion 11. The artificial eyelash main body 10 is slightly curved, and the tip portion 11 has a pointed tip. The artificial eyelash main body 10 in this embodiment has a length of, for example, 5 mm to 20 mm. An end face 15*a* of the end portion 15 has a diameter (or thickness) of, for example, 0.07 mm to 0.3 mm.

In the extension 300 in this embodiment, glue 21 is attached to the end portion 15. The extension 300 is bonded and thus fixed to the eyelash 50 with the glue 21.

Figure 29:
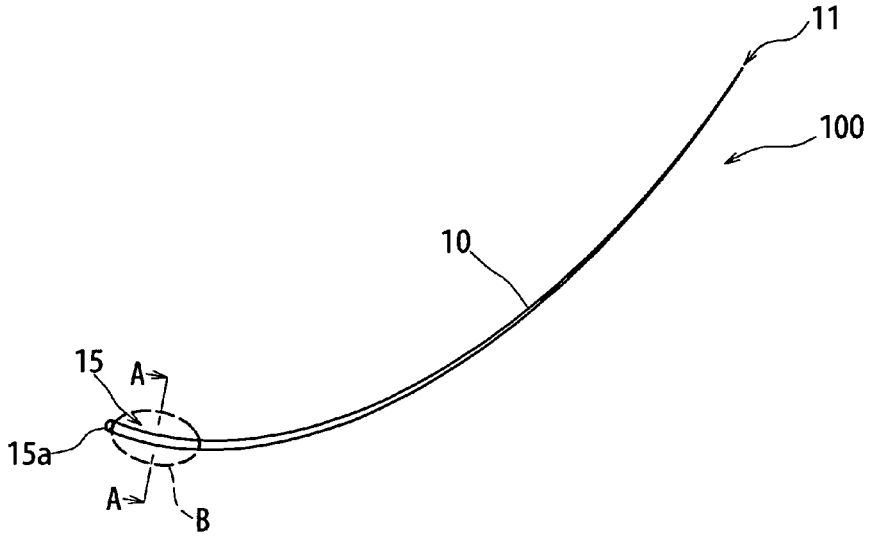
FIG. 29 is a perspective view showing a structure of the extension 300 in the embodiment according to the present invention.
Figure 30:
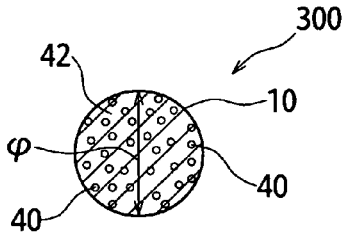
FIG. 30 is a cross-sectional view of the extension 300 taken along line A-A in FIG. 29.
Figure 31:
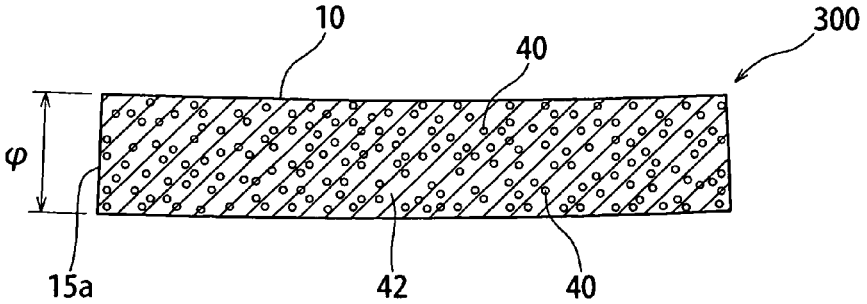
FIG. 31 is a cross-sectional view of part B of the extension 300 in FIG. 29.

FIG. 29 is a perspective view showing a structure of the extension 300 in this embodiment. FIG. 30 shows a cross-section taken along line A-A in FIG. 29. FIG. 31 shows a cross-sectional view of part B in FIG. 29.

According to the structure of this embodiment, the artificial eyelash main body 10 is formed of a resin 42, and the silver ions ($Ag^+$) 40 are dispersed in the resin 42. The silver ions are shown schematically in FIG. 30 and FIG. 31 for illustration. FIG. 30 and FIG. 31 show the diameter $\phi$ of the end portion 15.

The silver ions ($Ag^+$), which are antibacterial, are usable in the form of, for example, silver ion water or silver nanoparticles. A silver ion ($Ag^+$) is a silver ion existing as a cation obtained as a result of an electron being released from silver (Ag), which is an atom, and has a size of about 200 picometers, which is approximately the same as the size of a silver atom and is a general size of an atom. Silver ions can be eluted by, for example, subjecting silver to electrolysis in water. In silver ion water, silver ions are in an independently free state in water molecules and basically exist in an ion state in water. Two main methods for generating silver ions include an electrolysis method of sending an electric current through a pure silver electrode in water to generate silver ions, and a chemical method of incorporating a chemical containing silver ion components to water. Silver nanoparticles are silver particles reduced in size to the order of nanometers. Silver nanoparticles which are silver ions reduced in size to nanoparticles and held by alumina silica, which is a mineral, are also usable.

The resin used to form the artificial eyelash main body 10 in this embodiment is, for example, polybutylene terephthalate, polyester, acrylic resin, vinyl chloride or nylon. In this example, the artificial eyelash main body 10 is formed of polybutylene terephthalate (PBT). The artificial eyelash main body 10 may be formed of a black material or a different-colored material. The artificial eyelash main body 10 may be colored, for example, dark brown, purple, blue, pink, silver, green, light orange, light gold, red, wine red, white, yellow or the like, and thus can realize a color extension.

The artificial eyelash main body 10 in this embodiment can be formed as follows. The silver ions ($Ag^+$) 40 are incorporated into the resin 42 and these components (40, 42) are mixed together. Then, the mixture is extruded from a mold having an opening which defines the shape of the artificial eyelash main body 10. In more detail, the resin 42 containing the silver ions 40 is extruded from the mold to produce a fibriform member. The fibriform member is cut so as to have the length of the artificial eyelash main body 10. Then, a part of the artificial eyelash main body 10 obtained as a result of the cutting is immersed in a chemical to make the tip portion 11 of the artificial eyelash main body 10 thinner than the remaining part thereof. Thus, the extension 300 in this embodiment can be produced.

According to the structure of this embodiment, the silver ions 40 are incorporated into the resin (e.g., PBT) 42. The ratio (% by mass) of the silver ions 40 is 10% or less, typically, 5% or about 5%.

It is known that the silver ions 40 have an antibacterial effect, but it has not been known whether the silver ions 40 contained in the resin 42 used to form the extension 300 has an antibacterial effect. The present inventor performed an experiment on the antibacterial property of the extension 300 in this embodiment and obtained the following results.

The test method used was the bacteria solution absorption method of JIS L 1902 (2008). The test bacterium provided was Staphylococcus aureus NBRC 12732. As samples, test bacteria suspensions containing a surfactant (Tween80) were used. Sample A was the extension 300 in this embodiment, and sample B was an extension as a comparative example with no silver ions.

In the case of sample A (extension 300), the common logarithm value of the number of live bacteria was 4.3 immediately after inoculation and 4.3 after 18-hour culturing. The numerical value was not changed even after 18-hour culturing. The bacteriostatic activity value was 2.8. From this inspection result, the extension 300 was recognized to be antibacterial.

By contrast, in the case of sample B (comparative example), the common logarithm value of the number of live bacteria was 4.3 immediately after inoculation was inoculated and 6.4 after 18-hour culturing. The numerical value was confirmed to be increased after 18-hour culturing. The bacteriostatic activity value was 0.7. From this inspection result, the extension as the comparative example was not recognized to be antibacterial.

For reference, in the case of the cotton standard white cloth, the common logarithm value of the number of live bacteria was 4.3 immediately after inoculation and 7.2 after 18-hour culturing. As the criteria for recognizing the antibacterial property, a bacteriostatic activity value of 2.2 or greater can be used. The bacteriostatic activity value is found by (Mb−Ma)−(Mc−Mo). When the bacteriostatic activity value ≥2.2 regarding a certain substance, the substance is recognized to be antibacterial.

Mb is the average value of the common logarithm values of the number of live bacteria of three samples after 18-hour culturing in the unprocessed cloth (or standard cloth). Ma is the average value of the common logarithm values of the number of live bacteria of three samples immediately after inoculation to the unprocessed cloth (or standard cloth). Mc is the average value of the common logarithm values of the number of live bacteria of three samples after 18-hour culturing in the antibacterial-processed cloth (in this example, the material of the extension). Mo is the average value of the common logarithm values of the number of live bacteria of three samples immediately after inoculation to the antibacterial-processed cloth (in this example, the material of the extension 300.

As described above, the extension 300 in this embodiment was recognized to be antibacterial, whereas the extension as the comparative example was not recognized to be antibacterial. The difference between the results of the antibacterial properties of the two types of extensions was conspicuous.

The extension 300 in this embodiment can suppress the propagation of the bacteria (germs) owing to the antibacterial effect of the silver ions contained in the artificial eyelash main body 10. Namely, the extension can be antibacterial. Therefore, the extension 300, even if attached to the eyelash 50 for a long time, can suppress the harm which would have been caused by the propagation of the bacteria.

Silver ions can strongly adsorb cells of various types of bacteria, and block and thus extirpate the cellular enzymes. Thus, silver ions can control the propagation of bacteria. Silver ions have features of having a relatively strong antibacterial effect but of being highly safe to the human body. Therefore, even if the extension 300 is inadvertently put into the mouth of the user, there is substantially no problem caused by the silver ions.

Now, with reference to FIGS. 32(*a*) through (*c*), a method for attaching the extension 300 in this embodiment to the eyelash 50 will be described.

Figure 32A:
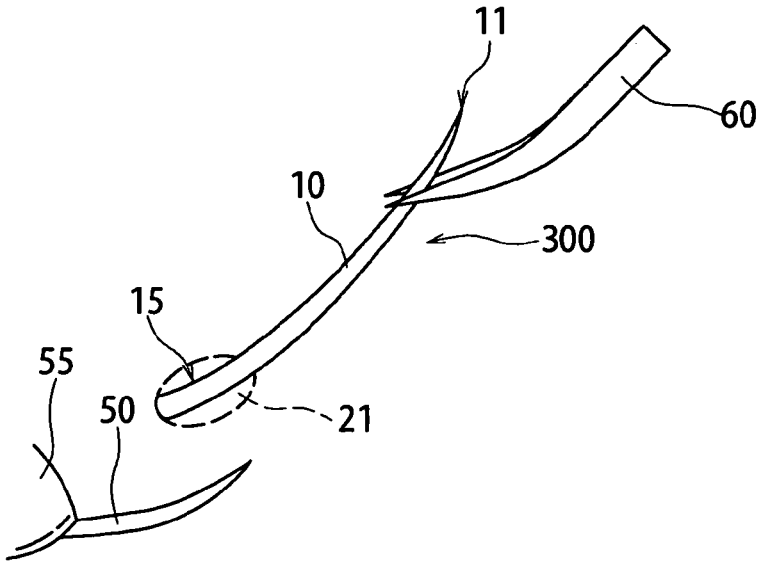
FIGS. 32(*a*) through (*c*) show a method for attaching the extension 300 to the eyelash 50.
Figure 32B:
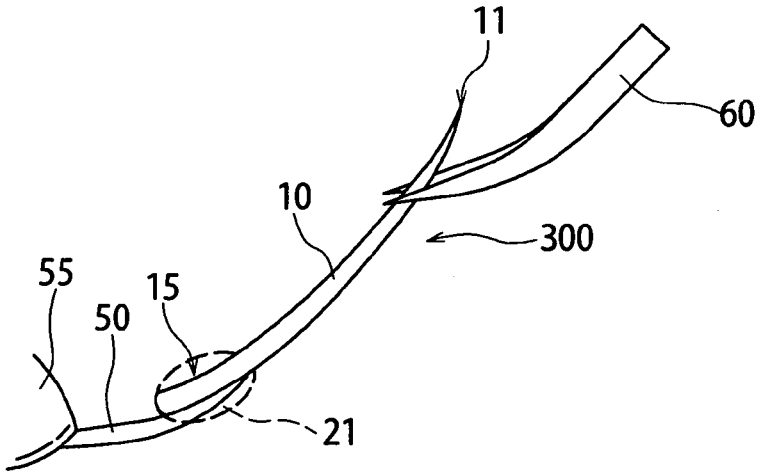
Figure 32C:
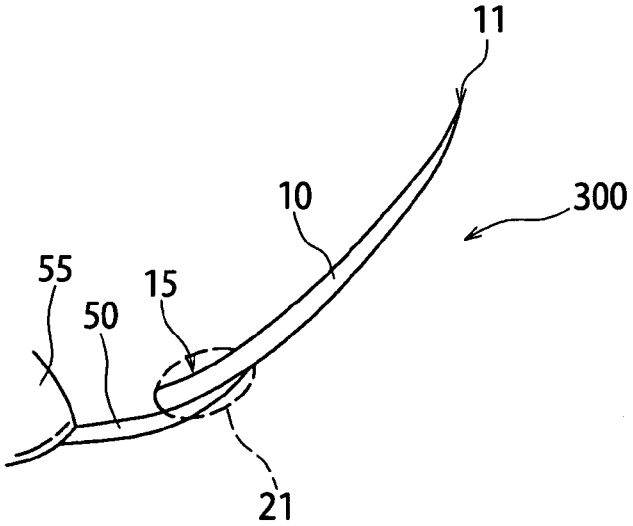

First, as shown in FIG. 32(*a*), a part of the extension 300 is picked up with tweezers 60, and the extension 300 is located near the eyelash 50 in the state where the glue 21 is applied to the end portion 15.

Next, as shown in FIG. 32(*b*), the glue 21 of the extension 300 is attached to the eyelash 50 and the extension 300 is put into close contact with the eyelash 50. When the glue 21 is cured to fix the extension 300 to the eyelash 50, as shown in FIG. 32(*c*), the tweezers 60 are detached. Thus, the attachment of the extension 300 is completed. This operation is conducted for each eyelash 50.

The extension 300 in this embodiment is antibacterial. Therefore, even if the extension 300 is touched with the fingers of the hand, instead of the tweezers 60, in any of the steps of FIGS. 32(*a*) through (*c*), the propagation of bacteria can be suppressed. In addition, even if the user (wearer) touches the extension 300 with his/her fingers after the extension 300 is attached to the eyelash 50, the propagation of bacteria can be suppressed.

When the extension 300 in this embodiment is attached to each upper eyelash 50, substantially the same state as that shown in FIG. 19 is obtained. The extensions 300 are attached to many eyelashes 50. When many extensions 300 are attached to the upper eyelashes 50, there are more chances that the fingers or skin touches the extension 300. However, the extension 300 in this embodiment is antibacterial and so can suppress the propagation of bacteria more than a conventional extension.

The extension 300 shown in FIG. 30 has a circular cross-section, but the present invention is not limited to this. The extension may have an elliptical (or substantially elliptical or egg-shaped) cross-section. Alternatively, the cross-section of the extension 300 may be polygonal (hexagonal, octagonal, etc.), or star-shaped (star-shaped with six apexes or eight apexes).

In the above-described structure, silver ions ($Ag^+$) are contained as an antibacterial material in the artificial eyelash main body 10. Alternatively, any other antibacterial material may be contained in the artificial eyelash main body 10 in the conditions in which such a material provides an antibacterial effect. For example, titanium oxide may be contained in the artificial eyelash main body 10 instead of (or in addition to) silver ions. Antibacterial materials other than silver ions or titanium oxide may be used. Usable antibacterial materials include inorganic antibacterial materials (which use the bacteriostatic activity of metal ions) and organic antibacterial materials (which use organic substances; synthetic type antibacterial materials and natural type antibacterial materials).

The structure of this embodiment is described above as being used for an extension (eyelash extension) but is not limited to this. The structure of this embodiment is also applicable to a false eyelash (see, for example, "16" in FIG. 7(*a*), "18" in FIG. 9. Namely, even where an antibacterial material (e.g., silver ions) is contained in the artificial eyelash main body (16, 18) of a false eyelash type, the propagation of bacteria can be suppressed more than in a conventional false eyelash since the artificial eyelash (false eyelash) 300 in this embodiment is antibacterial.

The present invention has been described by way of various embodiments. These embodiments do not limit the present invention, and the present invention can be modified in various manners, needless to say. For example, the artificial eyelashes (extensions) 100, 200, 250 and 300 in the above-described embodiments may be attached to lower eyelashes. As described above, in the states shown in, for example, FIGS. 32(*a*) through (*c*), the artificial eyelash main body 10 in any of the above-described embodiments of the extension may be temporarily attached to the eyelash 50 by use of a liquid (e.g., water or a liquid having a higher viscosity than that of water, typically, a liquid cosmetic material) instead of the glue 21. Such temporary attachment allows the user (wearer) 1000 to check the design or how he/she feels when wearing the extension in the embodiment. In the case of the extensions 200 and 250 in the embodiments according to the present invention, the use of a liquid (water or a liquid cosmetic material) has an advantage of making the temporary attachment operation easy because the artificial eyelash main body 10 has an increased surface area size and so has an increased force of holding the liquid owing to the surface tension thereof. In the case of the extension 300, the use of a liquid has an advantage of making the temporary attachment operation easy because the antibacterial material is hydrophilic, and when the antibacterial material is on the surface of the artificial eyelash main body 10, the surface has an increased force of holding the liquid.

In the above-described embodiments, the extensions (100, 200, 250, 300) are each attached to the eyelash 50 of the user (wearer) 1000. The eyelash 50 may be an eyelash portion of a false eyelash. Namely, the extension of any of the embodiments of the present invention can be attached to the eyelash portion 50 of a false eyelash, instead of a human eyelash. This way, a unique false eyelash which meets the tastes of the user can be produced. As a practice of attaching an extension, the extension 100 or the like may be attached to the eyelash portion 50 of a false eyelash. In the case where the extension 100 or the like is attached to the eyelash portion 50 of a false eyelash also, the above-described effects of the embodiments can be provided.

The structures of the embodiments may be appropriately combined. For example, the structure of the extension 100 in Embodiment 1 may be combined with the structure of the extension 300 in Embodiment 4 (antibacterial material). Specifically, an antibacterial material can be contained in the artificial eyelash main body 10 and/or the annular member 20 in Embodiment 1. The structure of the extension 200 or 250 in Embodiment 2 or 3 may be combined with the structure of the extension 300 in Embodiment 4 (antibacterial material). The structure of the extension 100 in Embodiment 1 may be combined with the structure of the extension 200 or 250 in Embodiment 2 or 3 to decrease the weight of the extension.

DESCRIPTION OF THE REFERENCE NUMERALS

10 Artificial eyelash main body
11 Tip portion
13 Artificial eyelash portion
14 Support portion
15 Root portion (end portion)
15*a* End face
16 Main body
17 Middle point
18 False eyelash (short type)
19 Artificial eyelash portion
20 Annular member
21 Glue
22 Annular member
22*a* Opening
24 Annular member
24*a* Opening
26 Band-like portion
27 Annular member
30 Surface portion
31 Concaved and convexed portion
32 Apex
33 Concaved and convexed portion
34 Groove
35 Surface portion
40 Silver ions (antibacterial material)
42 Resin
50 Eyelash (eyelash portion)
55 Skin
60 Tweezers
65 Extending direction
70 Heat
100 Extension
150 Extension
200 Extension
250 Extension
300 Extension
1000 User

What is claimed is:

1. An eyelash extension configured to increase a length of an eyelash, the eyelash extension comprising:

an artificial eyelash main body containing silver ions, wherein the silver ions are in the form of one selected from the group consisting of silver ion water and silver nanoparticles; and grooves formed in the artificial eyelash main body, wherein, the artificial eyelash main body includes a root portion contactable with the eyelash and a tip portion located opposite to the root portion, the root portion has a polygonal cross-section, the polygonal cross-section having at least five apexes and the grooves located between the apexes, the root portion of the artificial eyelash main body has a diameter larger than a diameter of the tip portion, and the artificial eyelash main body is formed of a resin, the silver ions being dispersed in the resin.

2. The eyelash extension of claim 1, wherein the apexes of the cross-section are located at apexes of a regular octagon, and the grooves are located between the apexes of the regular octagon.

3. The eyelash extension of claim 2, wherein the silver ions exist as cations obtained as a result of electrons being released from silver (Ag) atoms.

4. The eyelash extension of claim 1, wherein the root portion of the artificial eyelash main body has the diameter of 0.07 mm to 0.3 mm.

5. An artificial eyelash configured to increase a length of an eyelash, the artificial eyelash comprising:

an artificial eyelash main body including a tip portion and an end portion contactable with the eyelash;

grooves formed in the artificial eyelash main body, the end portion having a polygonal cross-section with at least five apexes and the grooves located between the apexes; and an antibacterial material contained in the artificial eyelash main body, wherein the end portion of the artificial eyelash main body has a diameter larger than a diameter of the tip portion, the antibacterial material is silver ions, the silver ions existing as cations obtained as a result of electrons being released from silver (Ag) atoms, the silver ions are in the form of one selected from the group consisting of silver ion water and silver nanoparticles, and the artificial eyelash main body is formed of a resin, the silver ions being dispersed in the resin.

6. The artificial eyelash of claim 5, wherein the artificial eyelash main body is an eyelash extension.

7. The artificial eyelash of claim 5, wherein the silver ions are dispersed entirely in the resin.

8. The artificial eyelash of claim 5, wherein:

the artificial eyelash main body is formed of a resin, the resin is polybutylene terephthalate, and the artificial eyelash main body has a circular cross-section.

9. The artificial eyelash of claim 5, wherein the artificial eyelash main body is an artificial eyelash portion for false eyelash type.

10. A method for attaching an artificial eyelash, comprising:

preparing an artificial eyelash main body containing an antibacterial material;

locating the artificial eyelash main body near an eyelash; and fixing the artificial eyelash main body to the eyelash, wherein the fixing of the artificial eyelash main body to the eyelash includes temporarily attaching the artificial eyelash main body to the eyelash using a liquid, and after temporarily attached, bonding the artificial eyelash main body to the eyelash with glue, the glue being different from the liquid, and wherein the antibacterial material is silver ions, the silver ions existing as cations obtained as a result of electrons being released from silver (Ag) atoms, the silver ions are in the form of one selected from the group consisting of silver ion water and silver nanoparticles, and the artificial eyelash main body is formed of a resin, the silver ions being dispersed in the resin.

11. A method for attaching an artificial eyelash, comprising:

preparing an artificial eyelash main body containing an antibacterial material;

locating the artificial eyelash main body near an eyelash; and fixing the artificial eyelash main body to the eyelash, wherein the antibacterial material is silver ions, the silver ions existing as cations obtained as a result of electrons being released from silver (Ag) atoms, the silver ions are in the form of one selected from the group consisting of silver ion water and silver nanoparticles, the artificial eyelash main body is formed of a resin, the silver ions being dispersed in the resin, grooves are formed in the artificial eyelash main body, the artificial eyelash main body includes a root portion contactable with the eyelash, and the root portion has a polygonal cross-section, the polygonal cross-section having at least five apexes and the grooves located between the apexes.

12. The method of claim 11, wherein the fixing of the artificial eyelash main body to the eyelash includes temporarily attaching the artificial eyelash main body to the eyelash using a liquid, the liquid being different from glue.

* * * * *